US010787873B2

(12) United States Patent
Biddick et al.

(10) Patent No.: US 10,787,873 B2
(45) Date of Patent: Sep. 29, 2020

(54) RECIRCULATION ISOLATOR FOR ARTIFICIAL LIFT AND METHOD OF USE

(71) Applicant: Upwing Energy, LLC, Cerritos, CA (US)

(72) Inventors: David Biddick, Houston, TX (US); Kuo-Chiang Chen, Kennedale, TX (US)

(73) Assignee: Upwing Energy, LLC, Cerritos, CA (US)

( * ) Notice: Subject to any disclaimer, the term of this patent is extended or adjusted under 35 U.S.C. 154(b) by 0 days.

(21) Appl. No.: 16/254,280

(22) Filed: Jan. 22, 2019

(65) Prior Publication Data

US 2020/0032599 A1 Jan. 30, 2020

Related U.S. Application Data

(63) Continuation-in-part of application No. 16/047,983, filed on Jul. 27, 2018, now Pat. No. 10,370,947.

(51) Int. Cl.
*E21B 23/01* (2006.01)
*E21B 23/14* (2006.01)
(Continued)

(52) U.S. Cl.
CPC ..... *E21B 23/01* (2013.01); *E21B 23/004* (2013.01); *E21B 23/14* (2013.01); *E21B 43/128* (2013.01); *E21B 33/12* (2013.01); *E21B 34/06* (2013.01)

(58) Field of Classification Search
CPC ..... E21B 23/01; E21B 23/14; E21B 23/004; E21B 43/128; E21B 33/12; E21B 34/06
See application file for complete search history.

(56) References Cited

U.S. PATENT DOCUMENTS 2,359,717 A * 10/1944 Myers ..... E21B 43/10 175/230
3,050,128 A * 8/1962 Brown ..... E21B 33/1295 166/120

(Continued)

FOREIGN PATENT DOCUMENTS

WO WO 2017021553 2/2017

OTHER PUBLICATIONS

PCT International Search Report and Written Opinion in International Appln. No. PCT/US2019/043585, dated Oct. 9, 2019, 14 pages.

(Continued)

*Primary Examiner* — David J Bagnell
*Assistant Examiner* — Yanick A Akaragwe
(74) *Attorney, Agent, or Firm* — Fish & Richardson P.C.

(57) ABSTRACT

A system includes a retrievable string for use in a completion string of a well, the completion string including an electrical stator. The retrievable string is to be disposed in the completion string, the retrievable string including a rotor for receipt within the electrical stator and to rotate in response to electromagnetic fields generated by the stator, an impeller coupled to the rotor, a housing to surround the impeller, and a recirculation isolator coupled to the housing. The recirculation isolator includes a sealing element and a locking tool, where the sealing element sealingly engages with the completion string, and the locking tool positions the retrievable string in the completion string and detachably couples the retrievable string to the completion string. The locking tool includes a rotational locking feature to engage an indexing receptacle of the completion string.

32 Claims, 14 Drawing Sheets

(51) Int. Cl.

| | |
|---|---|
| ***E21B 23/00*** | (2006.01) |
| ***E21B 43/12*** | (2006.01) |
| *E21B 34/06* | (2006.01) |
| *E21B 33/12* | (2006.01) |

(56) References Cited

U.S. PATENT DOCUMENTS

| | | | | |
|---|---|---|---|---|
| 5,216,308 | A | 6/1993 | Meeks | |
| 5,620,048 | A | 4/1997 | Beauquin | |
| 6,167,965 | B1 | 1/2001 | Bearden et al. | |
| 6,557,642 | B2 * | 5/2003 | Head | E21B 17/003 166/381 |
| 2001/0050173 | A1 | 12/2001 | Head | |
| 2003/0132003 | A1 | 7/2003 | Arauz et al. | |
| 2005/0186065 | A1 | 8/2005 | Wilson et al. | |
| 2006/0243450 | A1 | 11/2006 | Head | |
| 2007/0277969 | A1 | 12/2007 | Hall | |
| 2009/0025943 | A1 | 1/2009 | Clark et al. | |
| 2009/0078426 | A1 | 3/2009 | Blaquiere | |
| 2011/0011596 | A1 | 1/2011 | Martinez | |
| 2011/0021498 | A1 | 1/2011 | Stokes et al. | |
| 2011/0176941 | A1 | 7/2011 | Albers et al. | |
| 2013/0043019 | A1 | 2/2013 | Hansen | |
| 2013/0341033 | A1 | 12/2013 | Carstensen et al. | |
| 2014/0020907 | A1 | 1/2014 | Head | |
| 2014/0238666 | A1 * | 8/2014 | Walton | E21B 47/122 166/250.01 |
| 2014/0377080 | A1 | 12/2014 | Xiao | |
| 2015/0132159 | A1 | 5/2015 | Wilson et al. | |
| 2015/0136424 | A1 | 5/2015 | Hughes et al. | |
| 2015/0184487 | A1 | 7/2015 | Osborne | |
| 2016/0040508 | A1 * | 2/2016 | Webster | E21B 21/103 166/244.1 |
| 2017/0081925 | A1 | 3/2017 | Brown et al. | |
| 2017/0183935 | A1 | 6/2017 | Brown et al. | |
| 2017/0275950 | A1 | 9/2017 | Spencer et al. | |
| 2018/0045193 | A1 | 2/2018 | Tanner | |
| 2018/0066479 | A1 | 3/2018 | Head et al. | |

OTHER PUBLICATIONS

Al-Khalifa et al., 'ESP Reliability Lessons Learned from Three H2S Saudi Arabian Fields,' Society of Petroleum Engineers, SPE-184176-MS, Nov.-Dec. 2016, 13 pages.

* cited by examiner

RECIRCULATION ISOLATOR FOR ARTIFICIAL LIFT AND METHOD OF USE

CROSS-REFERENCE TO RELATED APPLICATIONS

This application is a Continuation-in-Part application of and claims the benefit of priority to U.S. patent application Ser. No. 16/047,983, entitled "ARTIFICIAL LIFT," filed Jul. 27, 2018, which is incorporated herein by reference in its entirety.

TECHNICAL FIELD

This disclosure relates to artificial lift systems, for example, including recirculation isolators.

BACKGROUND

Artificial lift equipment, such as electric submersible pumps, compressors, and blowers, can be used in downhole applications to increase fluid flow within a well, thereby extending the life of the well. Such equipment often requires complex tools to sufficiently position the artificial lift equipment in place for operation. Additionally, complex tools can be costly to implement, add weight to the overall system, and introduce additional points of possible failure, among other negative effects.

SUMMARY

This disclosure describes deployable and retrievable recirculation isolators of an artificial lift system disposed in a downhole environment.

In some aspects, a system for use in a completion string of a well, where the completion string includes an electrical stator, includes a retrievable string and a recirculation isolator. The retrievable string is to be disposed in the completion string of the well, the retrievable string including a rotor for receipt within the electrical stator and to rotate in response to electromagnetic fields generated by the stator, an impeller coupled to the rotor and positioned above the rotor relative to the position of the impeller in the well, a housing to surround the impeller, and the recirculation isolator coupled to the housing. The recirculation isolator includes a sealing element and a locking tool, the sealing element to sealingly engage with the completion string, and the locking tool to position the retrievable string in the completion string and detachably couple the retrievable string to the completion string. The locking tool includes a rotational locking feature to engage an indexing receptacle of the completion string and rotationally lock the retrievable string in the completion string, an axial positioning feature to axially position the recirculation isolator in the completion string, and an anchoring feature to axially lock the recirculation isolator to the completion string.

This, and other aspects, can include one or more of the following features. The retrievable string can include a rotational lock between the housing and the rotor, the rotational lock to selectively rotationally lock the rotor to the housing. The rotational locking feature can include a set of energized keys on the recirculation isolator, the energized keys to selectively extend and engage the indexing receptacle, and the indexing receptacle can include matching vertical slots in the completion string. The recirculation isolator can include a packer, the packer including the sealing element to radially expand to engage and seal against the completion string. The recirculation isolator can include a fluid channel through the recirculation isolator, the fluid channel to guide fluid flow from the impeller through the recirculation isolator. The recirculation isolator can include a check valve in the fluid channel of the recirculation isolator to allow fluid flow in a first direction through the fluid channel and to restrict fluid flow in a second direction opposite the first direction through the fluid channel. The check valve can be a passive, one-way check valve. The recirculation isolator can include a running feature connection at a longitudinal end of the recirculation isolator, the running feature connection to selectively couple to a running tool. The recirculation isolator can include a plug proximate an uphole longitudinal end of the recirculation isolator, the plug to at least partially seal against the completion string and urge the recirculation isolator along the completion string in response to an applied pressure against the plug. The locking tool can include a first shoulder of the recirculation isolator, the first shoulder to land on and engage a second shoulder of the completion string at a predetermined depth of the completion string. The axial positioning feature of the recirculation isolator can include a magnetic sensor to generate a voltage signal in response to aligning with a magnetic component of the completion string. The locking tool can include a retractable key to selectively expand and retract in a radial direction, the retractable key to engage a locking profile of the completion string. The locking tool can include a slip assembly including a slip plate to expand radially outward to engage a surface of the completion string. The slip plate can include at least one of horizontal teeth or vertical teeth, the horizontal teeth to dig into the surface of the completion string to axially secure the slip plate to the completion string, and the vertical teeth to dig into the surface of the completion string to rotationally secure the slip plate to the completion string. The slip assembly can include a radial guide to guide movement of the slip plate a radial direction toward the surface of the completion string. The recirculation isolator can include a second locking tool, where the first-mentioned locking tool is positioned at a first longitudinal side of the rotor and the second locking tool is positioned at a second longitudinal side of the rotor opposite the first longitudinal side. The system can include a stator configured to attach to a tubing of the completion string, where the stator is to drive the rotor in response to receiving power. The retrievable string can include a motor permanent magnet, and the system can include an electromagnetic coil to, in response to the electromagnetic coil receiving power, generate a first magnetic field to engage the motor permanent magnet and cause the rotor to rotate. The retrievable string can include a rotating portion and a non-rotating portion, where the rotating portion comprises the rotor and the impeller, and the non-rotating portion comprises the housing and the recirculation isolator.

Some aspects of the disclosure encompass a method for locking a retrievable string in a completion string. The method includes positioning, with a locking tool of a recirculation isolator of a retrievable string, the retrievable string in a completion string. The completion string includes an electrical stator, and the retrievable string includes a rotor for receipt within the electrical stator and to rotate in response to electromagnetic fields generated by the stator, an impeller coupled to the rotor, a housing to surround the impeller, and the recirculation isolator coupled to the housing. The method also includes anchoring, with the locking tool, the retrievable string to the completion string, where anchoring the retrievable string to the completion string includes engaging, with a rotational locking feature of the locking tool, an indexing receptacle of the completion string to rotationally lock the retrievable string to the completion string, engaging, with an axial positioning feature of the locking tool, the completion string to axially position the recirculation isolator in the completion string, and engaging, with an anchoring feature of the locking tool, the completion string to axially lock the recirculation isolator to the completion string. The method also includes sealing, with a sealing element of the recirculation isolator, the retrievable string to the completion string.

This, and other aspects, can include one or more of the following features. Positioning the retrievable string in the completion string can include landing a first shoulder of the locking tool of the recirculation isolator on a second shoulder of the completion string at a predetermined depth of the completion string. Engaging, with a rotational locking feature, an indexing receptacle can include selectively engaging, with a set of energized keys on the recirculation isolator, matching vertical slots of the indexing receptacle. Anchoring the retrievable string to the completion string can further include axially positioning the retrievable string in the completion string with an axial positioning feature of the recirculation isolator, and axially locking the retrievable string to the completion string with an anchoring feature of the locking tool. Anchoring the retrievable string to the completion string can include engaging a slip plate of a slip assembly of the locking tool with a surface of the completion string. Engaging a slip plate of a slip assembly with a surface of the completion string can include digging horizontal teeth of the slip plate into the surface of the completion string. Engaging a slip plate of a slip assembly with a surface of the completion string can include digging vertical teeth of the slip plate into the surface of the completion string. Sealing the retrievable string to the completion string can include setting a packer of the recirculation isolator to radially expand and engage the completion string, the packer including the sealing element. The method can further include unsealing the sealing element of the recirculation isolator with the completion string, and unsetting the locking tool from anchoring engagement with the completion string. The method can further include engaging, with a pulling tool carried on a cable, the recirculation isolator, and retrieving the retrievable string from the completion string.

Certain aspects of the disclosure include a system for use in a well completion. The system includes a production tubing string to be set in a wellbore to form a well completion, the production tubing string including a landing sub and an electrical stator disposed in the well completion, the landing sub comprising an indexing receptacle, and a retrievable string to be disposed in the production tubing string in the wellbore. The retrievable string includes a rotor for receipt within the electrical stator and to rotate in response to electromagnetic fields generated by the stator, an impeller coupled to the rotor and positioned above the rotor relative to the position of the impeller in the production tubing string, and a recirculation isolator including a sealing element and a locking tool. The sealing element sealingly engages with the well completion, and the locking tool detachably couples to the landing sub to position, axially lock, and rotationally lock the retrievable string to the well completion. The locking tool includes a rotational locking feature to engage the indexing receptacle of the landing sub and rotationally lock the retrievable string to the landing sub, an axial positioning feature to axially position the recirculation isolator at the landing sub, and an anchoring feature to axially lock the recirculation isolator to the landing sub.

This, and other aspects, can include one or more of the following features. The axial positioning feature of the recirculation isolator can include a magnetic sensor configured to generate a voltage signal in response to aligning with a magnetic component of the production tubing string. The locking tool can include a first shoulder of the recirculation isolator, and the landing sub can include a second shoulder having a matching profile to the first shoulder, the first shoulder to land on and engage the second shoulder at a predetermined depth of the well completion. The locking tool can include a slip assembly including a slip plate to expand radially outward to engage a surface of the landing sub. The rotational locking feature can include a set of energized keys on the recirculation isolator, and the indexing receptacle can include matching vertical slots in the completion string, where the set of energized keys selectively extend and engage one or more of the matching vertical slots of the indexing receptacle.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
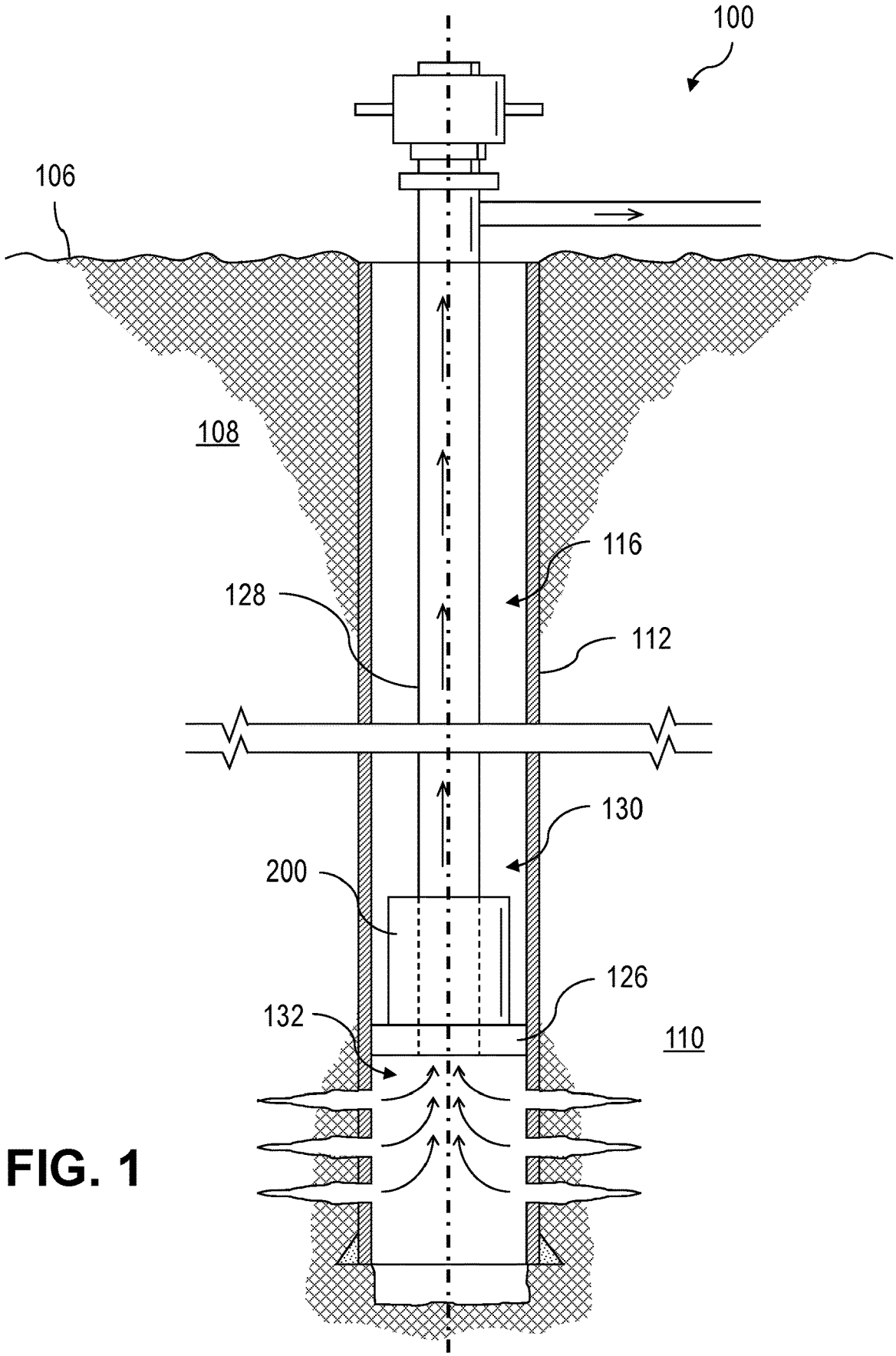
FIG. 1 is a schematic partial cross-sectional side view of an example well.

This disclosure describes artificial lift systems, including deployable and retrievable recirculation isolators, in a downhole environment. A retrievable string including an artificial lift system and a recirculation isolator lands on and engages with a landing sub, production tubing, or other structure of a well completion in a wellbore to provide assisted fluid flow to the wellbore. For example, a slickline with a running tool connects to running features on an uphole end of the recirculation isolator to lower the retrievable string into the wellbore. As the retrievable string reaches a desired, predetermined depth, sealing features, locking features, and/or indexing features on the recirculation isolator engage with elements of the well completion to axially index (i.e., position), rotationally lock, anchor, and seal the recirculation isolator to the well completion. The recirculation isolator includes a plurality of features to axially index, axially lock, rotationally lock, and seal the recirculation isolator, such that the deployable and retrievable string with the recirculation isolator can operate as a standalone tool that does not require additional indexing tools, additional locking tools, or other additional downhole tools to operate.

Reliably indexing (e.g., axial positioning) downhole-type equipment in a hostile downhole environment is sometimes difficult due to the presence of caustic fluids, pressures, temperatures, and a relative distance between the downhole equipment and any supporting equipment (e.g., surface equipment) that cannot be repackaged to fit in a small diameter tube. For example, many conventional downhole systems include multiple tools connected (directly or indirectly) together at different downhole depths in order to provide uphole axial indexing, downhole axial indexing, and rotational indexing. However, conventional use of multiple indexing tools can be complex, difficult to activate and deactivate, and difficult to operate. Also, the artificial lift systems described herein can be more reliable than comparable artificial lift systems, resulting in lower total capital costs over the life of a well. The improved reliability can also reduce the frequency of workover procedures, thereby reducing periods of lost production and maintenance costs. The modular characteristic of the artificial systems described herein allows for variability in design and customization to cater to a wide range of operating conditions. The artificial lift systems described herein include a deployable and retrievable string, which can be removed from the well simply and quickly. A replacement retrievable string can then be installed quickly to minimize lost production, thereby reducing replacement costs and reducing lost production over the life of a well.

While issues and risks exist for downhole operations, the potential benefit of well intervention with production-enhancing tools, such as artificial lift tools and other downhole-type tools, is often worth the risk because of the enhanced production it can offer, among other benefits. While these benefits have been demonstrated, reliability, robustness, and operability of equipment in this harsh and remote environment is not close to conventional topside mounted equipment. The concepts described herein improve reliability and ease of use of downhole-type tools and equipment, for example, by providing the downhole tool with an arrangement of positioning and indexing features to reliably position and secure the tool. The concepts described herein regard the local positioning, indexing, and locking of a deployable and retrievable downhole tool, such as a retrievable string with a recirculation isolator, relative to a production tubing or other well completion in a wellbore.

FIG. 1 is a schematic partial cross-sectional side view of an example well 100 constructed in accordance with the concepts herein. The well 100 extends from the surface 106 through the Earth 108 to one or more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. For simplicity's sake, the well 100 is shown as a vertical well, but in other instances, the well 100 can be a deviated well with a wellbore deviated from vertical (for example, horizontal or slanted) and/or the well 100 can include multiple bores, forming a multilateral well (that is, a well having multiple lateral wells branching off another well or wells).

In some implementations, the well 100 is a gas well that is used in producing natural gas from the subterranean zones of interest 110 to the surface 106. While termed a "gas well," the well need not produce only dry gas, and may incidentally or in much smaller quantities, produce liquid including oil and/or water. In some implementations, the well 100 is an oil well that is used in producing crude oil from the subterranean zones of interest 110 to the surface 106. While termed an "oil well,": the well not need produce only crude oil, and may incidentally or in much smaller quantities, produce gas and/or water. In some implementations, the production from the well 100 can be multiphase in any ratio, and/or can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly and/or otherwise) end-to-end of the same size or of different sizes. In FIG. 1, the casing 112 is perforated in the subterranean zone of interest 110 to allow fluid communication between the subterranean zone of interest 110 and the bore 116 of the casing 112. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached the wellhead. The Christmas tree includes valves used to regulate flow into or out of the well 100. The well 100 also includes an artificial lift system 200 residing in the wellbore, for example, at a depth that is nearer to subterranean zone 110 than the surface 106. The system 200, being of a type configured in size and robust construction for installation within a well 100, can include any type of rotating equipment that can assist production of fluids to the surface 106 and out of the well 100 by creating an additional pressure differential within the well 100. For example, the system 200 can include a pump, compressor, blower, or multiphase fluid flow aid.

In particular, casing 112 is commercially produced in a number of common sizes specified by the American Petroleum Institute (the "API), including 4½, 5, 5½, 6, 6⅝, 7, 7⅝, 16/8, 9⅝, 10¾, 11¾, 13⅜, 16, 116/8 and 20 inches, and the API specifies internal diameters for each casing size. The system 200 can be configured to fit in, and (as discussed in more detail below) in certain instances, seal to the inner diameter of one of the specified API casing sizes. Of course, the system 200 can be made to fit in and, in certain instances, seal to other sizes of casing or tubing or otherwise seal to a wall of the well 100.

Additionally, the construction of the components of the system 200 are configured to withstand the impacts, scraping, and other physical challenges the system 200 will encounter while being passed hundreds of feet/meters or even multiple miles/kilometers into and out of the well 100. For example, the system 200 can be disposed in the well 100 at a depth of up to 20,000 feet (6,096 meters). Beyond just a rugged exterior, this encompasses having certain portions of any electrical components being ruggedized to be shock resistant and remain fluid tight during such physical challenges and during operation. Additionally, the system 200 is configured to withstand and operate for extended periods of time (e.g., multiple weeks, months or years) at the pressures and temperatures experienced in the well 100, which temperatures can exceed 400° F./205° C. and pressures over 2,000 pounds per square inch, and while submerged in the well fluids (gas, water, or oil as examples). Finally, the system 200 can be configured to interface with one or more of the common deployment systems, such as jointed tubing (that is, lengths of tubing joined end-to-end, threadedly and/or otherwise), sucker rod, coiled tubing (that is, not-jointed tubing, but rather a continuous, unbroken and flexible tubing formed as a single piece of material), slickline (that is, a single stranded wire), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector). Some components of the system 200 (such as non-rotating parts and electrical systems, assemblies, and components) can be part of or attached to the production tubing 128 to form a portion of the permanent completion or well completion, while other components (such as rotating parts) can be deployed within the production tubing 128.

A seal system 126 integrated into or provided separately with a downhole system, as shown with the system 200, divides the well 100 into an uphole zone 130 above the seal system 126 and a downhole zone 132 below the seal system 126. FIG. 1 shows the system 200 positioned in the open volume of the bore 116 of the casing 112, and connected to a production string of tubing (also referred as production tubing 128) in the well 100. The wall of the well 100 includes the interior wall of the casing 112 in portions of the wellbore having the casing 112, and includes the open hole wellbore wall in uncased portions of the well 100. Thus, the seal system 126 is configured to seal against the wall of the wellbore, for example, against the interior wall of the casing 112 in the cased portions of the well 100 or against the interior wall of the wellbore in the uncased, open hole portions of the well 100. In certain instances, the seal system 126 can form a gas-tight and liquid-tight seal at the pressure differential the system 200 creates in the well 100. For example, the seal system 126 can be configured to at least partially seal against an interior wall of the wellbore to separate (completely or substantially) a pressure in the well 100 downhole of the seal system 126 from a pressure in the well 100 uphole of the seal system 126. For example, the seal system 126 includes a production packer. Although not shown in FIG. 1, additional components, such as a surface compressor, can be used in conjunction with the system 200 to boost pressure in the well 100.

In some implementations, the system 200 can be implemented to alter characteristics of a wellbore by a mechanical intervention at the source. Alternatively, or in addition to any of the other implementations described in this specification, the system 200 can be implemented as a high flow, low pressure rotary device for gas flow in sub-atmospheric wells. Alternatively, or in addition to any of the other implementations described in this specification, the system 200 can be implemented in a direct well-casing deployment for production through the wellbore. Other implementations of the system 200 as a pump, compressor, or multiphase combination of these can be utilized in the well bore to effect increased well production.

The system 200 locally alters the pressure, temperature, and/or flow rate conditions of the fluid in the well 100 proximate the system 200. In certain instances, the alteration performed by the system 200 can optimize or help in optimizing fluid flow through the well 100. As described previously, the system 200 creates a pressure differential within the well 100, for example, particularly within the locale in which the system 200 resides. In some instances, a pressure at the base of the well 100 is a low pressure (for example, sub-atmospheric); so unassisted fluid flow in the wellbore can be slow or stagnant. In these and other instances, the system 200 introduced to the well 100 adjacent the perforations can reduce the pressure in the well 100 near the perforations to induce greater fluid flow from the subterranean zone 110, increase a temperature of the fluid entering the system 200 to reduce condensation from limiting production, and/or increase a pressure in the well 100 uphole of the system 200 to increase fluid flow to the surface 106.

The system 200 moves the fluid at a first pressure downhole of the system 200 to a second, higher pressure uphole of the system 200. The system 200 can operate at and maintain a pressure ratio across the system 200 between the second, higher uphole pressure and the first, downhole pressure in the wellbore. The pressure ratio of the second pressure to the first pressure can also vary, for example, based on an operating speed of the system 200.

The system 200 can operate in a variety of downhole conditions of the well 100. For example, the initial pressure within the well 100 can vary based on the type of well, depth of the well 100, production flow from the perforations into the well 100, and/or other factors. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The system 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The system 200 can operate in above atmospheric well pressures, for example, at well pressure between 14.7 psia (101.3 kPa) and 5,000 psia (34,474 kPa).

Figure 2:
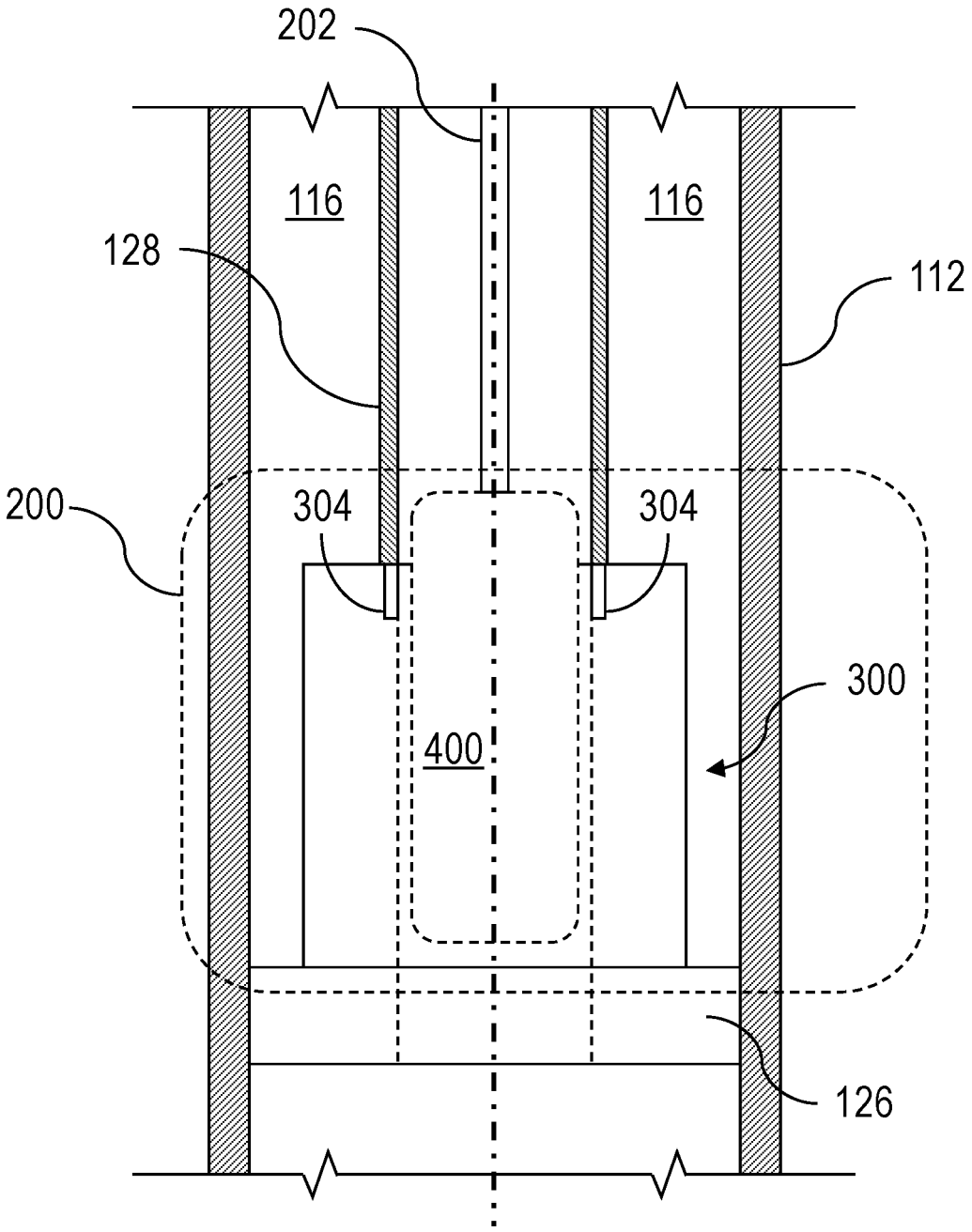
FIG. 2 is a schematic partial cross-sectional side view of an example system within the well of FIG. 1.

FIG. 2 is a schematic partial cross-sectional side view of the example system 200 in the well 100 of FIG. 1. The example system 200 includes a subsystem 300 and a retrievable string 400. The subsystem 300 is installed as a portion of a completion string of the well 100. In some instances, the subsystem 300 is referred as the well completion in this disclosure. In some implementations, the subsystem 300 (in part or in whole) is part of the casing and can be cemented in place within the well 100. The subsystem 300 can be connected to the seal system 126 (for example, a production packer) to form a part of the completion string of the well 100. Similarly, the subsystem 300 can be connected to and/or include part of the production tubing 128 to form part of the completion string of the well 100. The retrievable string 400 can be configured to interface with one or more of the common deployment systems described previously (for example, slickline), such that the retrievable string 400 can be deployed downhole into the well 100 and retrieved from the well 100. For example, a cable 202 in the form of a slickline is shown as connected to the retrievable string 400. However, the cable 202 can take a variety of other forms, as described previously, such as a slickline, wireline, e-line, coil tubing, sucker rod, a combination of these, or other deployment cable. At least a portion of the retrievable string 400 can be positioned within the subsystem 300. In some implementations, the entire retrievable string 400 can be positioned within the subsystem 300.

The subsystem 300 and the retrievable string 400 each include corresponding coupling parts that are cooperatively configured to couple the retrievable string 400 and the subsystem 300 to each other. For example, the subsystem 300 includes a landing sub 304 formed in the completion string, for example, as part of the production tubing 128, and the retrievable string 400 includes a recirculation isolator 404 (described later) configured to at least partially engage with the landing sub 304. Coupling the corresponding landing sub 304 and the recirculation isolator 404 can secure the relative positions of the subsystem 300 and the retrievable string 400 to each other. The subsystem 300 and the retrievable string 400 are detachably coupled to each other via the landing sub 304 and the recirculation isolator 404—that is, the subsystem 300 and the retrievable string 400 can subsequently be decoupled and detached from each other. The landing sub 304 and recirculation isolator 404 can include corresponding indexing features and locking features, for example, to axially index (i.e., axially position) and rotationally lock the retrievable string 400 to the subsystem 300. The landing sub 304 and recirculation isolator 404 can each take a variety of forms, and are described in greater detail later in this disclosure.

In some implementations, the subsystem 300 includes a stator 302 (described later), which can attach to a tubing of the completion string (such as the production tubing 128). The retrievable string 400 includes a rotor 402 (described later). While the retrievable string 400 is coupled to the subsystem 300, the stator 302 is configured to drive the rotor 402 in response to receiving power. In some implementations, the electrical components are part of the stator 302 of the subsystem 300, while the retrievable string 400 is free of electrical components. In some implementations, the subsystem 300 is free of rotating components. The concepts herein likewise apply to a generator, where the rotor 402 is spun and generates electricity in the coils of the stator 302.

Figure 3:
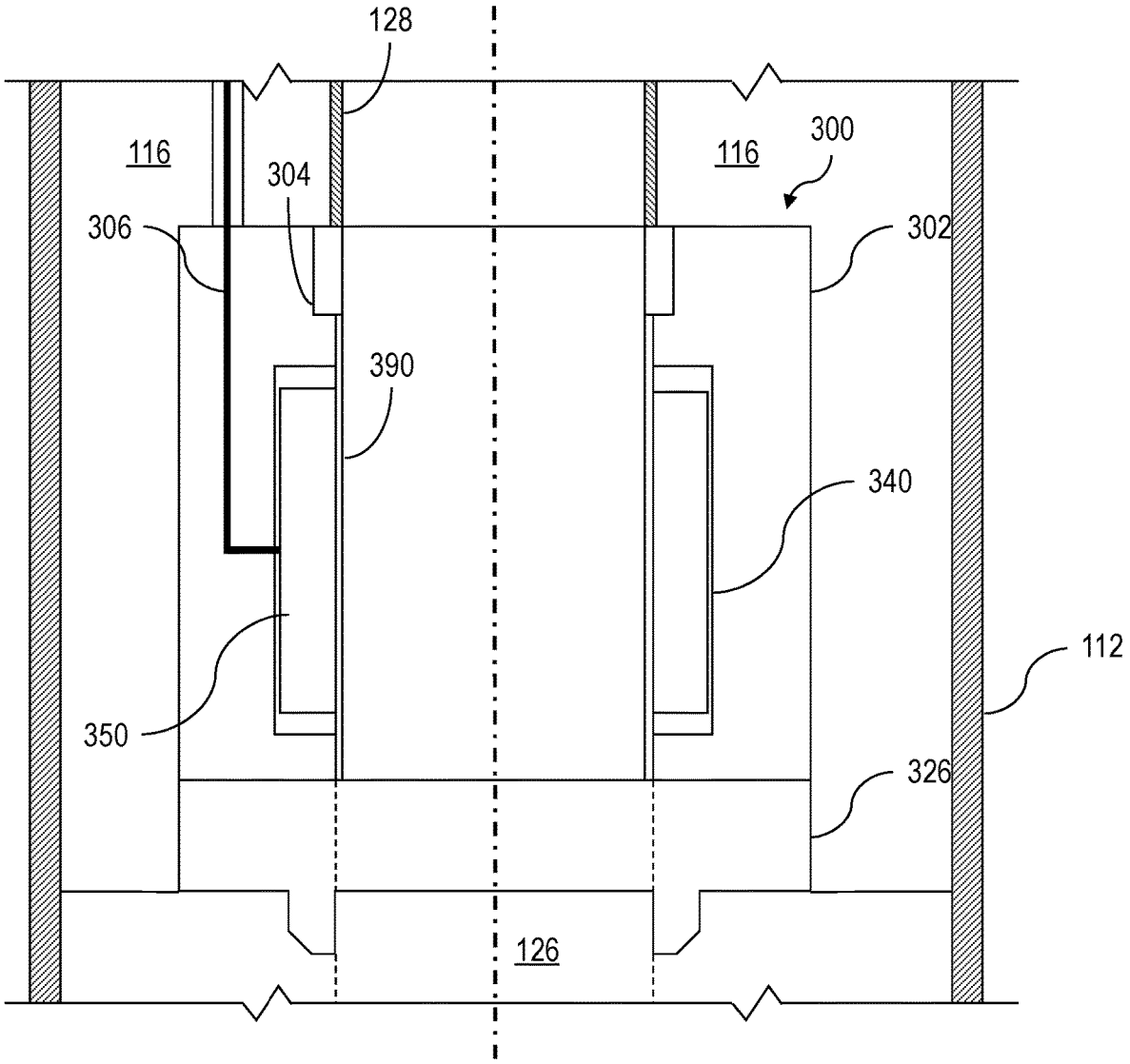
FIG. 3 is a schematic diagram of an example subsystem in the well of the system of FIG. 2.

Referring to FIG. 3, the subsystem 300 can include an electrical connection 306, a seal 326, and an electromagnetic coil 350. Although described as separate components, a conglomerate of various components of the subsystem 300 can be referred as the stator 302. For example, the stator 302 is sometimes referenced in this disclosure as including the seal 326 and the electromagnetic coil 350. The stator 302 has an inner surface defined by an inner diameter, and the stator 302 can define a chamber 340 formed on the inner surface. The chamber 340 can house the electromagnetic coil 350. The stator 302 can include a protective sleeve 390 that is configured to attach to the production tubing 128. The protective sleeve 390 can be configured to isolate the chamber 340 from production fluid (that is, fluid produced from the subterranean zone 110). The protective sleeve 390 can be metallic or non-metallic. The protective sleeve 390 can be made of a material suitable for the environment and operating conditions (for example, downhole conditions). For example, the protective sleeve 390 can be made of carbon fiber or Inconel. The protective sleeve 390 can serve a similar purpose as the production tubing 128, that is, isolating the casing from production fluid, while also allowing magnetic flux to penetrate from the stator 302, through the sleeve 390, and into the inner space of the production tubing 128. The protective sleeve 390 can be a part of (that is, integral to) the production tubing 128 or can be attached to the production tubing 128.

The electrical connection 306 is connected to the electromagnetic coil 350. The electrical connection 306 can include a cable positioned in an annulus, such as the inner bore 116 between the casing 112 and the production tubing 128. The annulus can be filled with completion fluid, and the completion fluid can include a corrosion inhibitor in order to provide protection against corrosion of the electrical connection 306. The electrical connection 306 can be connected to a power source located within the well 100 or at the surface 106 via the cable to supply power to the electromagnetic coil 350. The electrical connection 306 can be connected to the chamber 340 and can be configured to prevent fluid from entering and exiting the chamber 340 through the electrical connection 306. The electrical connection 306 can be used to supply power and/or transfer information. Although shown as having one electrical connection 306, the subsystem 300 can include additional electrical connections. The electrical connection 306 can also be configured to use an inductive coupler (not shown) to provide electrical power to the stator coil(s), where the inductive coupler can connect to the stator 302 outward of the production tube 128 or protective sleeve of the stator 302, and connect to the cable 306 from the surface within the production tube 128 or protective sleeve of the stator 302. This connection of the inductive coupler minimizes the cable in the subsystem 300, putting the electrical connection cable 306 within the retrievable string 400, which makes the electrical connection cable 306 more easily replaceable.

The seal 326 can be positioned at a downhole end of the subsystem 300. The seal 326 can be configured to directly or indirectly connect to a production packer disposed in the well downhole of the stator 302 (such as the production packer 126 disposed in the well 100), in order to isolate an annulus between the stator 302 and the well 100 (such as the inner bore 116 between the casing 112 and the stator 302) from a producing portion of the well 100 downhole of the annulus (for example, the downhole zone 132). In some implementations, the seal 326 is a seal stack that is configured to connect to (for example, stab into) a polished bore receptacle connected to the production packer 126 in order to form a pressure-tight barrier.

In some implementations, the subsystem 300 includes additional components, such as a thrust bearing actuator, a radial bearing actuator, and/or a cooling circuit, and the chamber 340 can house the additional components. In some implementations, the stator 302 defines one or more additional chambers (separate from the chamber 340) which can house any additional components. In some implementations, the subsystem 300 includes one or more sensors, which can be configured to measure one or more properties (such as a property of the well 100, a property of the stator 302, or a property of the retrievable string 400). Some non-limiting examples of properties that can be measured by the one or more sensors are pressure (such as downhole pressure), temperature (such as downhole temperature or temperature of the stator 302), fluid flow (such as production fluid flow), fluid properties (such as viscosity), fluid composition, a mechanical load (such as an axial load or a radial load), and a position of a component (such as an axial position or a radial position of the rotor 402).

In some implementations, the subsystem 300 includes additional components or duplicate components (such as multiple stators 302) that can act together or independently to provide higher output or redundancy to enhance long-term operation. In some implementations, the subsystem 300 is duplicated one or more times to act together with other subsystems to provide higher output or independently for redundancy. The presence of multiple subsystems 300 can enhance long-term operation. In some implementations (for example, where multiple subsystems 300 operate in conjunction to provide higher well output), each additional or duplicate subsystem 300 can operate with different retrievable strings. In some implementations (for example, where multiple subsystems 300 operate independently for redundancy), each additional or duplicate subsystem 300 can operate with a single retrievable string (such as the retrievable string 400), which can be relocated within the well depending on whichever subsystem the retrievable string is operating with to provide well output.

Figure 4A:
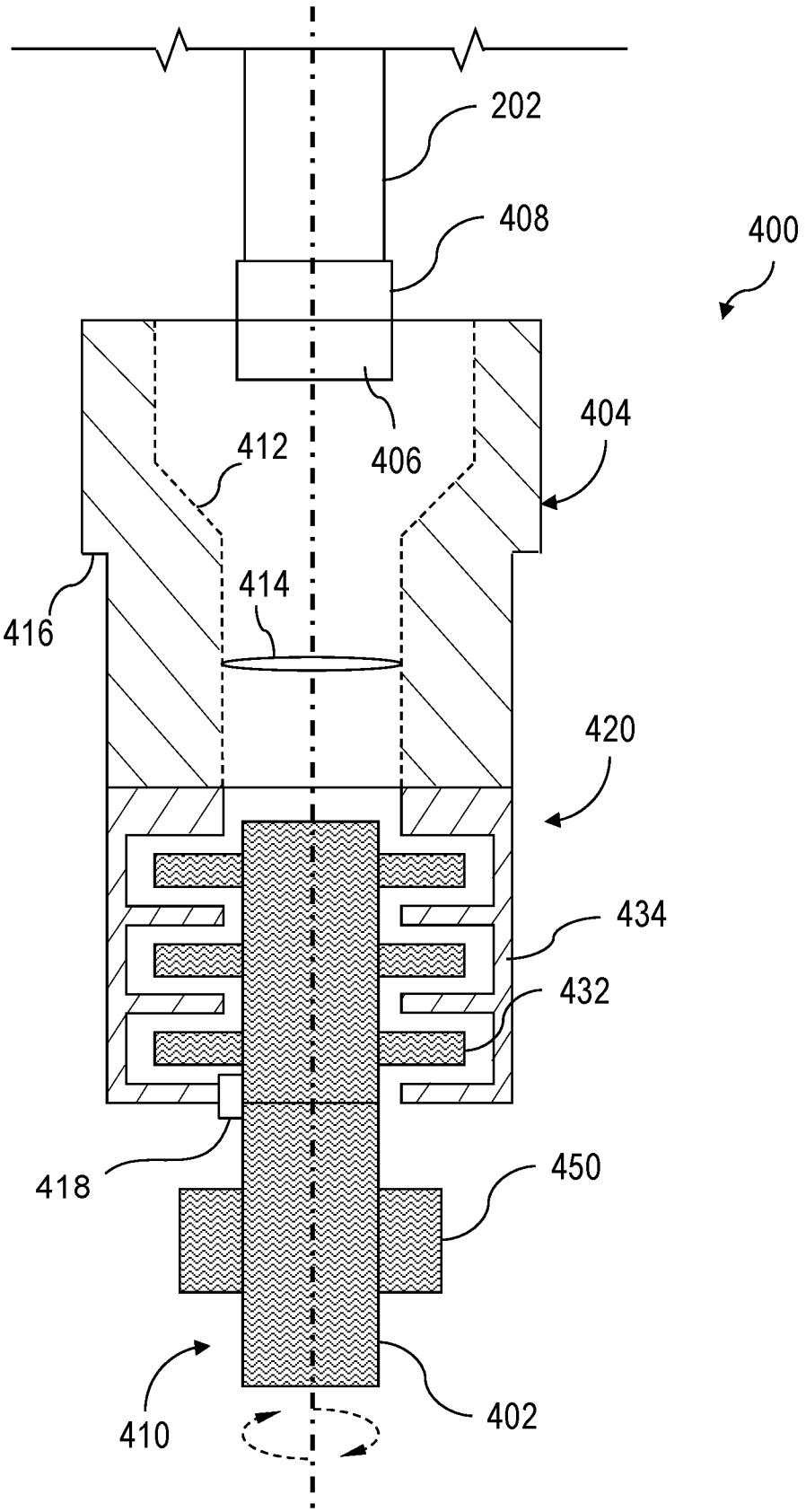
FIG. 4A is a schematic partial cross-sectional side view of an example retrievable string of the system of FIG. 2.

FIG. 4A is a schematic partial cross-sectional side view of the retrievable string 400. Referring to FIG. 4A, the retrievable string 400 includes a rotating portion 410 and a non-rotating portion 420. The rotating portion 410 includes the rotor 402, and the non-rotating portion 420 includes the recirculation isolator 404. In response to receiving power, the electromagnetic coil 350 of the subsystem 300 can be configured to generate a magnetic field to engage a motor permanent magnet 450 of the retrievable string 400 and cause the rotor 402 to rotate. The electromagnetic coil 350 and the motor permanent magnet 450 interact magnetically. The electromagnetic coil 350 and the motor permanent magnet 450 each generate magnetic fields, which attract or repel each other. The attraction or repulsion imparts forces that cause the rotor 402 to rotate. The subsystem 300 and the retrievable string 400 can be designed such that corresponding components are located near each other when the retrievable string 400 is positioned in the subsystem 300. For example, when the retrievable string 400 is positioned in the subsystem 300, the electromagnetic coil 350 is in the vicinity of the motor permanent magnet 450. As one example, the electromagnetic coil 350 is constructed similar to a permanent magnet motor stator, including laminations with slots filled with coil sets constructed to form three phases with which a produced magnetic field can be sequentially altered to react against a motor permanent magnetic field and impart torque on a motor permanent magnet, thereby causing the rotor 402 to rotate.

The retrievable string 400 is configured to be positioned in a well (such as the well 100). The rotor 402 of the retrievable string 400 is configured to be positioned in and driven by a stator of a well completion (such as the stator 302). The retrievable string 400 includes at least one impeller 432 coupled to the rotor 402. The non-rotating portion 420 of the retrievable string 400 and the impeller 432 are cooperatively configured to induce fluid flow in the well 100 from an inlet of the string 400 to an outlet of the string 400 in response to the stator 302 driving the rotor 402. The recirculation isolator 404 is configured to support the retrievable string 400 to position the rotor 402 in (e.g., adjacent to) the stator 302, and can detachably couple to the corresponding landing sub 304 and/or other structures (e.g., production tubing 128) of the well completion (subsystem 300). The landing sub 304 of the subsystem 300 and the recirculation isolator 404 of the retrievable string 400 act to position, secure, and seal the retrievable string 400 relative to the subsystem 300 to ensure proper alignment of the rotor 402 with the stator 302. The recirculation isolator 404 is configured to isolate the output of the non-rotating portion 420 of the retrievable string 400 and the impeller 432 from the inlet, flowing fluid from a downward, or downhole location to an upward, or uphole location.

The example retrievable string 400 of FIG. 4A includes a motor permanent magnet 450 and in some instances, includes a protective sleeve at least partially surrounding the motor permanent magnet 450. The protective sleeve can surround the rotor 402 and can be similar to the protective sleeve 390 lining the inner diameter of the stator 302. The protective sleeve can be metallic or non-metallic. For example, the protective sleeve can be made of carbon fiber or Inconel.

The motor permanent magnet 450 is configured to cause the rotor 402 to rotate in response to the magnetic field generated by the electromagnetic coil 350 of the stator 302. With the rotor 402 configured to rotate, the retrievable string 400 can make up at least part of an electric submersible pump, a compressor, a blower, a combination of these, or another rotational lift tool. For example, the rotating portion 410 includes the impellers 432 and central rotating shaft of an electric submersible pump, while the non-rotating portion 420 includes the diffuser and/or housing 434 of the electric submersible pump. The concepts herein likewise apply to a generator, where the rotor 402 is spun and generates electricity in the stator coils 350 of the stator 302. For example, unassisted production fluid flow through the retrievable string 400 can drive the impeller(s) 432 to rotate, thereby rotating the rotor 402 and the permanent magnet 450 to generate electricity in the electromagnetic coil(s) 350 of the stator 302. The retrievable string 400 can be exposed to production fluid from the subterranean zone 110, and the electric submersible pump can include a fluid inlet and a fluid outlet for flow of production fluid across the pump. In some implementations, the retrievable string 400 includes a protector configured to protect a portion of the rotor 402 against contamination of production fluid. In some implementations, the retrievable string 400 can allow production fluid from the subterranean zone 110 to flow over an outer surface of the rotor 402. In some implementations, production fluid from the subterranean zone 110 flows through the annulus defined between the outer surface of the rotor 402 and the inner surface of the stator 302 (or the protective sleeve 390). In some implementations, production fluid from the subterranean zone 110 can flow through an inner bore of the rotor 402.

In some implementations, the retrievable string 400 includes a rotational lock 418 between the non-rotating portion 420 (e.g., housing 434, or recirculation isolator 404) and the rotatable portion 410 (e.g., the rotor 402, or impellers 432) to temporarily lock rotation of the rotatable portion 410 relative to the non-rotating portion 420, for example, as the retrievable string 400 is run into the well 100. The rotational lock 418 is temporary, and selectively rotationally locks the rotor 402 to the housing 434, for example, until the locking tool of the recirculation isolator 404 engages, where the rotor 402 and stator poles of the stator 302 are aligned prior to releasing the rotational lock between the rotor 402 and the housing 434. The selective rotational lock 418 can take a variety of forms. For example, the rotational lock 418 can include a retractable key on the rotor 402 or impellers 432 that can selectively retract or extend to disengage or engage, respectively, a slot in the non-rotating portion 420 (e.g., housing 434). In some examples, the rotational lock 418 includes a frangible element on the rotor 402 or impellers 432 that temporarily locks rotation of the rotor 402 relative to the housing 434, or an abradable material on the rotor 402 or impellers 432 that forms a temporary friction lock against the housing 432. The temporary, or selective, rotational lock 418 can allow for a safer deployment of the retrievable string 400 during deployment of the string 400 by restricting (completely or substantially) rotational movement of the rotor 402 as the retrievable string 400 traverses uphole or downhole in the well completion. The rotational lock 418 also rotationally positions the rotor 402 at a predetermined rotational position, for example, such that the position of the rotor 402 relative to the subsystem 300 is known as the retrievable string 400 is anchored to the subsystem 300.

The recirculation isolator 404 is coupled to the non-rotating housing 434 of the pump. The fluid outlet of the pump is fluidly coupled to a fluid channel 412 of the recirculation isolator 404 to allow fluid flow through the recirculation isolator, for example, in an uphole direction. The fluid channel 412 guides fluid flow from the pump through the recirculation isolator 404 and out of the recirculation isolator 404 at an uphole longitudinal end of the recirculation isolator 404. The non-rotating housing 434 can include axial and radial bearings, where the non-rotating housing 434 conveys to the recirculation isolator 404, in addition to the system weight associated with the tool itself, forces generated during operation of the subsystem 300. The recirculation isolator 404 is configured to support these loads during all operating conditions of the tool by anchoring to the landing sub 304, thereby transferring loads to the permanent completion structure. In some implementations, the recirculation isolator 404 includes a check valve 414 in the fluid channel 412 of the recirculation isolator 404, for example, to prevent or reduce backflow of fluids or solids through the fluid channel 412 toward the pump. The check valve 414 can be a passive, one-way check valve with a valve seat, such as a flapper valve, ball valve, diaphragm check valve, tilting disc valve, a lift-check valve, another type of shuttle valve energized by a spring, a combination of these, or another type of one-way valve.

The recirculation isolator 404 of the non-rotating portion 420 of the retrievable string 400 enables deployment, indexing, sealing, operation, and retrieval of the retrievable string 400. The recirculation isolator 404 can selectively connect to the well completion (i.e., subsystem 300, landing sub 304, and/or production tubing 128) and prevent rotation of the non-rotating portion 420 while the rotating portion 410 rotates. Connecting the recirculation isolator 404 to the well completion can also locate (that is, position) the non-rotating portion 420 relative to the well completion and prevent axial movement of the non-rotating portion 420 relative to the well completion in either an uphole or downhole direction. In particular, the recirculation isolator 404 includes conveyance and retrieval features to convey and retrieve the retrievable string 400 from the well, axial indexing features to position the retrievable string 400 relative to the well completion, anchoring features to axially lock the retrievable string 400 in the well completion, anti-rotation features to rotationally lock the retrievable string 400 in the well completion, and sealing features to seal the annulus between the retrievable string 400 and the well completion. One or more locking tools of the recirculation isolator 404 can include one or more of these conveyance and retrieval features, axial indexing features, anchoring features, anti-rotation features, or sealing features. This locking tool(s) and its respective conveyance and retrieval features, axial indexing features, anchoring features, anti-rotation features, and/or sealing features can take many forms.

For example, the recirculation isolator 404 of the example retrievable string 400 of FIG. 4A includes a running feature connection 406 positioned at an uphole end of the retrievable string 400. The running feature connection 406 is configured to connect to and engage a running tool 408 carried on a cable, such as cable 202, from a location at the surface 106, allowing the retrievable string 400 to be deployed in the well 100 and, additionally or alternatively, retrieved from the well 100 after the retrievable string 400 (i.e., the recirculation isolator 404) has been decoupled from the subsystem 300 and/or other parts of the well completion. The running feature connection 406, running tool 408, and cable 202 can make up the conveyance and retrieval features of the recirculation isolator 404. In FIG. 4A, the running tool 408 of the cable 202 is shown as being coupled to the running feature connection 406 of the recirculation isolator 404. In some implementations, the retrievable string 400 includes the running tool 408 and cable 202 (such as a slickline, wireline, or coiled tubing) configured to connect to the running feature connection 406 of the recirculation isolator 404. The cable can extend to lower the retrievable string 400 into the well 100 and retract to retrieve the retrievable string 400 from the well 100. In some implementations, once the retrievable string 400 is installed in the well 100, the running tool 408 of the cable 202 can be disconnected from the running feature connection 406 of the recirculation isolator 404 of the retrievable string 400, and the cable 202 and running tool 408 are retrieved from the well 100 so that the cable 202 is not hanging within the production tubing 128 while the well 100 is producing.

Figure 5A:
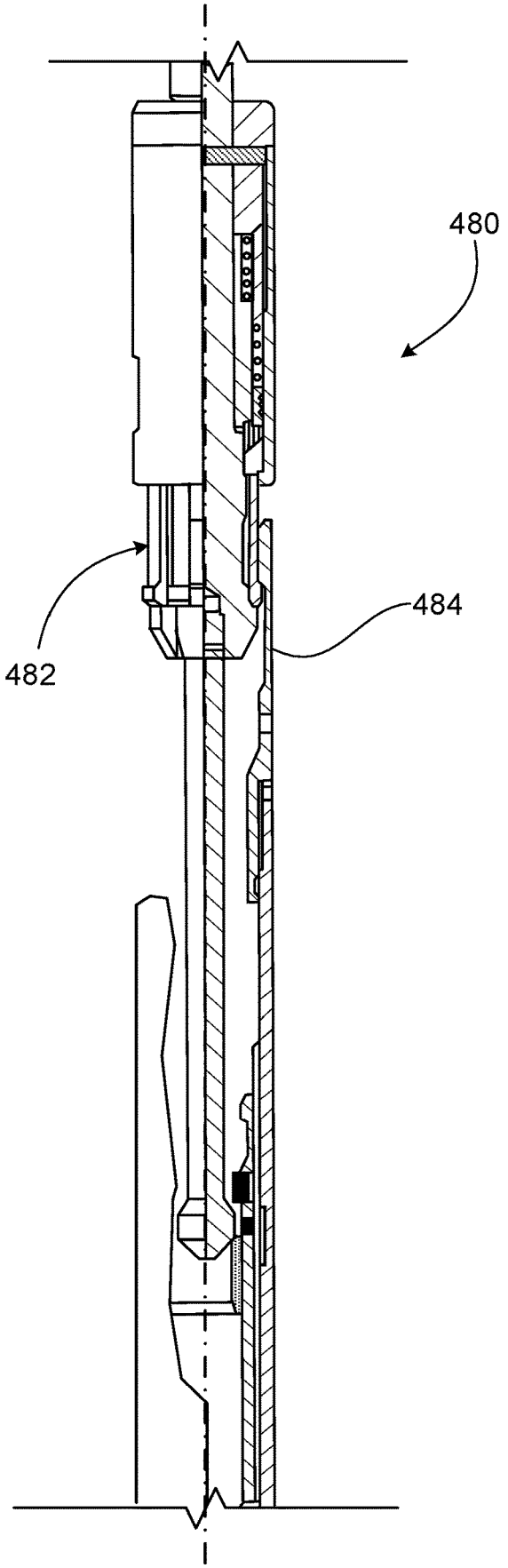
FIG. 5A is a half cross-sectional side view of an example running connection tool including a fishing tool and fishing neck.

The running feature connection 406 and the running tool 408 can take a variety of forms, and can engage with each other in a variety of ways to connect, interface, and disconnect from each other. For example, the running tool 408 can include a lip or shoulder of a mechanical member (e.g., collets, retainer dogs, keys, lugs, and/or other) to engage with a shoulder in a recess of the running feature connection 406. The running feature connection 406 includes a profile configured to engage with the running tool 408, such as the recess with the shoulder to engage with the lip of the mechanical member of the running tool 408. In some examples, the running feature connection 406 includes a fishing neck, such as an external or internal fishing neck, and the running tool 408 includes a fishing hook configured to engage with the fishing neck of the running feature connection 406. FIG. 5A is a half cross-sectional side view of an example running connection tool 480 including a fishing tool 482 and fishing neck 484, which can be used in the running tool 408 and running feature connection 406 of FIG. 4A. The fishing neck 484 includes an inner profile configured to selectively engage with an outer profile of the fishing tool 482. The fishing tool 482 can selectively expand or retract to engage or disengage the corresponding fishing neck 484, for example, during deployment and retrieval of the running connection tool 480.

Referring back to FIG. 4A, the running feature connection 406, running tool 408, and cable 202 can function to trigger, activate, and/or deactivate a feature of the recirculation isolator 404. In some implementations, the running tool 408 can trigger the activation of the recirculation isolator 404. This triggering can be achieved mechanically (e.g., manipulations of the cable, jar-up and jar-down by cable and jar), electrically (e.g., sending electrical signals via wireline conductor to start the sequence of activation), hydraulically (e.g., changing the downhole pressure to a pre-set value to start a sequence of activation), or acoustically (e.g., sending a certain patterns of frequency or magnitude of acoustic wave via with the column of fluids of the well or the well completions to start a preset sequence of activation). In certain implementations, the running tool 408 can activate the recirculation isolator 404 by mechanical energy (e.g., manipulations of the cable, jar-up and jar-down by cable and jar), electrical energy (e.g., electrical power via wireline conductor or stored electrical power in batteries), hydraulic energy (e.g., increase the downhole pressure to act on an atmospheric chamber), or chemical energy (e.g., ignite propellants to increase gas pressure on one side of a actuation piston against the atmospheric pressure on the other side of the actuation piston). In some implementations, the running tool 408 can disengage the recirculation isolator 404, for example, once activation is completed. This disengagement between the running tool 408 and the recirculation isolator 404 can happen so that the running tool 408 and cable 202 can be retrieved. This disengagement can be achieved by unlocking (or breaking) the connections (e.g. keyed, or pinned) between a member of the running tool 408 and a member of the recirculation isolator 404 at a final sequence of the activation.

For example, the running tool 408 can exert a force on the recirculation isolator 404 by manipulation of the cable 202, such as by pulling or releasing the cable 202, and/or jarring up or down on the running tool 408. The cable manipulation can shear a frangible element (e.g., shear pin) of the recirculation isolator, for example, to activate or deactivate a mechanism of the recirculation isolator 404. In some examples, cable manipulation can also dislodge a component from gripping engagement with a profile (e.g., drive a spring finger, soft metal/elastomer/frangible ring, or snap ring past a shoulder or profile or pull a ball or pin from a detent) to set (activate) or unset (deactivate) a feature of the retrievable string 400. In some implementations, the running tool 408 includes a conventional wireline setting tool, such as an explosive setting tool or an electrical setting tool, to break one or more frangible elements (e.g., shear one or more shear pins) or dislodge grippingly engaged components that sets or unsets a mechanism of the recirculation isolator 404, such as keys, sleeves, locks, slips, wedges, valves, a combination of these, or other features. In certain implementations, the running tool 408 can connect and/or disconnect from the running feature connection 406 with the force from an explosive setting tool or rotational/axial movement from an electrical setting tool, by sending an electrical signal via the cable 202 (e.g., wireline) to activate a mechanism, or by sending an acoustic signal to activate a mechanism of the running feature connection 406 or running tool 408.

The running feature connection 406 and running tool 408 can also act as a pulling feature connection and pulling tool, respectively, to engage and retrieve the retrievable string 400. The pulling feature connection and pulling tool can take a variety of forms, as described earlier with respect to the running feature connection 406 and running tool 408. In some instances, the pulling tool (i.e., running tool 408) includes a set of slips to engage the pulling feature connection (i.e., running feature connection 406), for example, where there is no recess or shoulder on the pulling feature connection of the recirculation isolator 404.

In some implementations, the recirculation isolator 404 of the retrievable string 400 includes a plug (not shown) in addition to or instead of the running feature connection 406. The plug can be positioned at the uphole end of the retrievable string 400 and can be configured to allow the retrievable string 400 to be pumped down into the well. For example, the plug can include a low pressure seal, and fluidic pressure can be applied on top of the plug in order to push the retrievable string 400 down into the well 100. The running feature connection 406 can be configured to be connected by an electrical connection, which can be used to transfer signals to and from a location at the surface 106. For example, one or more sensors of the non-rotating portion 420 can transmit signals to and from a location at the surface 106 through the electrical connection connected to the running feature connection 406.

The axial indexing features of the recirculation isolator 404 position the retrievable string 400 at a desired depth in the well. The axial indexing features can be formed in the housing of the recirculation isolator, and are configured to engage part of the well completion, such as the landing sub 304. For example, the recirculation isolator 404 of example retrievable string 400 of FIG. 4A includes a shoulder 416 that defines a landing surface in the housing of the non-rotating portion 420 of the recirculation isolator 404. The shoulder 416 defines a radial protrusion from an outer surface of the isolator 404. As the retrievable string 400 is lowered into the well, the shoulder 416 lands on a corresponding shoulder of the well completion (e.g., corresponding shoulder of landing sub 304). The shoulder 416 and the corresponding shoulder of the well completion are positioned such that, when the shoulder 416 lands on the corresponding shoulder of the well completion, the retrievable string 400 is at a predetermined, desired axial position in the well. The predetermined axial position can include a relative position between the retrievable string 400 and the subsystem 300 such that the coils 350 of the stator 302 align with the magnet(s) 450 of the rotor 402. The corresponding shoulder of the well completion can be formed in the landing sub 304, the production tubing 128, or another component of the subsystem 300. In some examples, the landing sub 304 includes a no-go profile, such as a no-go shoulder, to engage with a corresponding profile, such as shoulder 416, of the recirculation isolator 404. The no-go profile prevent the retrievable string 400 from passing beyond the depth of the no-go profile, and can indicate the predetermined depth that the retrievable string 400 is to be positioned at.

In some instances, the axial indexing features of the recirculation isolator 404 can also act as a rotationally lock feature. For example, the shoulder 416 of the recirculation isolator 404 and the corresponding shoulder of the well completion can include rotational locking features such that engagement of the shoulders together both axially positions and rotationally locks the retrievable string 400 relative to the subsystem 300. In some examples, the shoulder 416 and the corresponding shoulder of the well completion can include splines, keys, or other alignment structures to rotationally lock the non-rotating portion 420 of the retrievable string 400 to the subsystem 300.

The axial indexing features can take other forms to axially index the retrievable string 400 in the well. In some implementations, the axial indexing features include a shoulder (e.g., shoulder 416) of the recirculation isolator 404 to land on a corresponding shoulder of the well completion, a spring biased key, dog or snap ring to snap into engagement with a corresponding profile of the well completion (or vice versa), a magnetic sensor or magnet to engage with a corresponding magnet or magnetic sensor of the well completion which, in turn, send a signal confirming axial indexing to the operator, a combination of these features, or other axial indexing features. In some examples, the recirculation isolator 404 includes a lock with one or more keys configured to engage a corresponding profile (e.g., recess) in the landing sub 304, stator 302, production tubing 128, or other component of the subsystem 300 or well completion. The keys can be spring-loaded to radially expand and engage the corresponding profile as the keys reach the profile. The keys can also be radially retractable, for example, to disengage the keys from the profile. In certain implementations, the axial indexing features include a selective or non-selective lock and nipple profile, such as a no-go lock and nipple profile. In some examples, the recirculation isolator 404 includes a magnet or magnetic sensor, and the landing sub 304 includes a corresponding magnetic sensor or magnet, such that a magnetic field from the magnet triggers the corresponding magnetic sensor or coils to indicate the predetermined depth when the magnet from the recirculation isolator 404 aligns with the corresponding magnetic sensor from the landing sub 304 (or the magnetic sensor from the recirculation isolator 404 aligns with the magnet from the landing sub 304). As the rotor is deployed in the well, a magnetic sensor or magnetic bearing stator can provide positive measurement of rotor axial location, where voltage present on the stator or a signal from the magnetic sensor is used to determine rotor location. In some implementations, a magnetic bearing stator can be energized to hold the rotor in place, and can allow for a soft landing of the rotor and retrievable string 400 onto a step or other feature of the well completion. For example, the recirculation isolator can include the magnetic sensor that can generate a voltage signal in response to aligning with a magnetic component of the completion string, where the axial positioning feature of the locking tool of the recirculation isolator includes the magnetic sensor. In some instances, the axial indexing features include magnetic or electro-magnetic features. For example, the permanent completion can include a permanent magnet positioned at a predetermined depth, and the axial indexing features includes a magnetic switch on the recirculation isolator 404 that can be activated by the permanent magnet on the completion to indicate that the desired depth has been reached. In some examples, an RFID tag in the permanent completion can indicate to an RFID sensor in the recirculation isolator 404 that the desired depth has been reached. In certain examples, the completion string can include a varying thickness of a metallic wall, where the recirculation isolator 404 includes a casing collar locator to sense and identify the change of wall thickness to indicate a desired depth. In some examples, the motor stator windings (e.g., the electromagnetic coils 350 of the stator 302) can act to provide positive measurement of rotor axial location. For example, as the rotor 402 is deployed in and lowered in the wellbore, a voltage present on the stator can be used to determine rotor axial position. The stator can be energized to hold the rotor (in cases where the motor portion is deployed separately from the pump portion), which can allow for a soft landing of the rotor into a step or other feature of the well completion.

The anti-rotation (rotational locking) features of the recirculation isolator 404 rotationally lock the non-rotating portion 420 of the retrievable string 400 relative to the subsystem 300. In some instances, the subsystem 300 includes an indexing receptacle (for example, in the landing sub 304, or elsewhere in the well completion) to engage the rotational locking feature of the locking tool of the recirculation isolator 404. The rotational locking features ensure that the non-rotating portion 420 of the retrievable string 400 is rotationally fixed relative to the subsystem 300, for example, during operation of the pump (e.g., rotation of the impeller 432). Due to the symmetry of the rotor 402 and the coils 350 of the stator 302, the recirculation isolator 404 can rotationally lock the retrievable string 400 relative to the subsystem 300 at any radial position. It is not required to radially index the retrievable string at a specific alignment for the rotor 402 and stator coils 350 to operate. In some implementations, the rotational locking features include a set of spline teeth on the recirculation isolator 404 and corresponding spline teeth on the landing sub 304, a set of energized keys on the recirculation isolator 404 and matching vertical slots on the landing sub 304, a set of slips with vertical teeth to bite into an inside diameter of the well completion (e.g., landing sub 304 or production tubing 128), a combination of these features, or other rotational locking features. In some examples, the rotational locking features includes any shape of protrusions, or alternating protrusions with recesses, corresponding to matching recesses (or imprints, deformation, or cutting into a surface) with interference edges of the landing sub 304, that can function to stop relative radial or rotational motions between the recirculation isolator 404 and the landing sub 304.

The anchoring features of the recirculation isolator 404 axially lock the retrievable string 400 in the well completion. The anchoring features axially lock the recirculation isolator 404 to substantially prevent uphole or downhole movement of the retrievable string 400 relative to the well completion, and can also rotationally lock the non-rotating portion 420 of the retrievable string 400. The anchoring features can be formed in the housing of the recirculation isolator, and are configured to engage part of the well completion, such as the landing sub 304. In some implementations, the anchoring features include a retractable key to engage with a corresponding profile of the well completion, a lock and nipple profile, a tubing stop, anchor, or packer with a set of slips having teeth to bite into the inside diameter surface of the well completion (e.g., landing sub 304), a combination of these features, or other anchoring features. In some examples, the recirculation isolator 404 includes a lock with one or more keys configured to engage a corresponding profile (e.g., recess) in the landing sub 304, stator 302, production tubing 128, or other component of the subsystem 300 or well completion. The keys can be spring-loaded to radially expand and engage the corresponding profile as the keys reach the profile. The keys can also be radially retractable, for example, to disengage the keys from the profile. In certain implementations, the axial indexing features include a selective or non-selective lock and nipple profile, such as a no-go lock and nipple profile. In some examples, the anchoring features includes any shape of protrusions, or alternating protrusions with recesses, corresponding to matching recesses (or imprints, deformation, or cutting into a surface) with interference edges of the landing sub 304, that can function to stop relative axial motions between the recirculation isolator 404 and the landing sub 304.

Figure 5B:
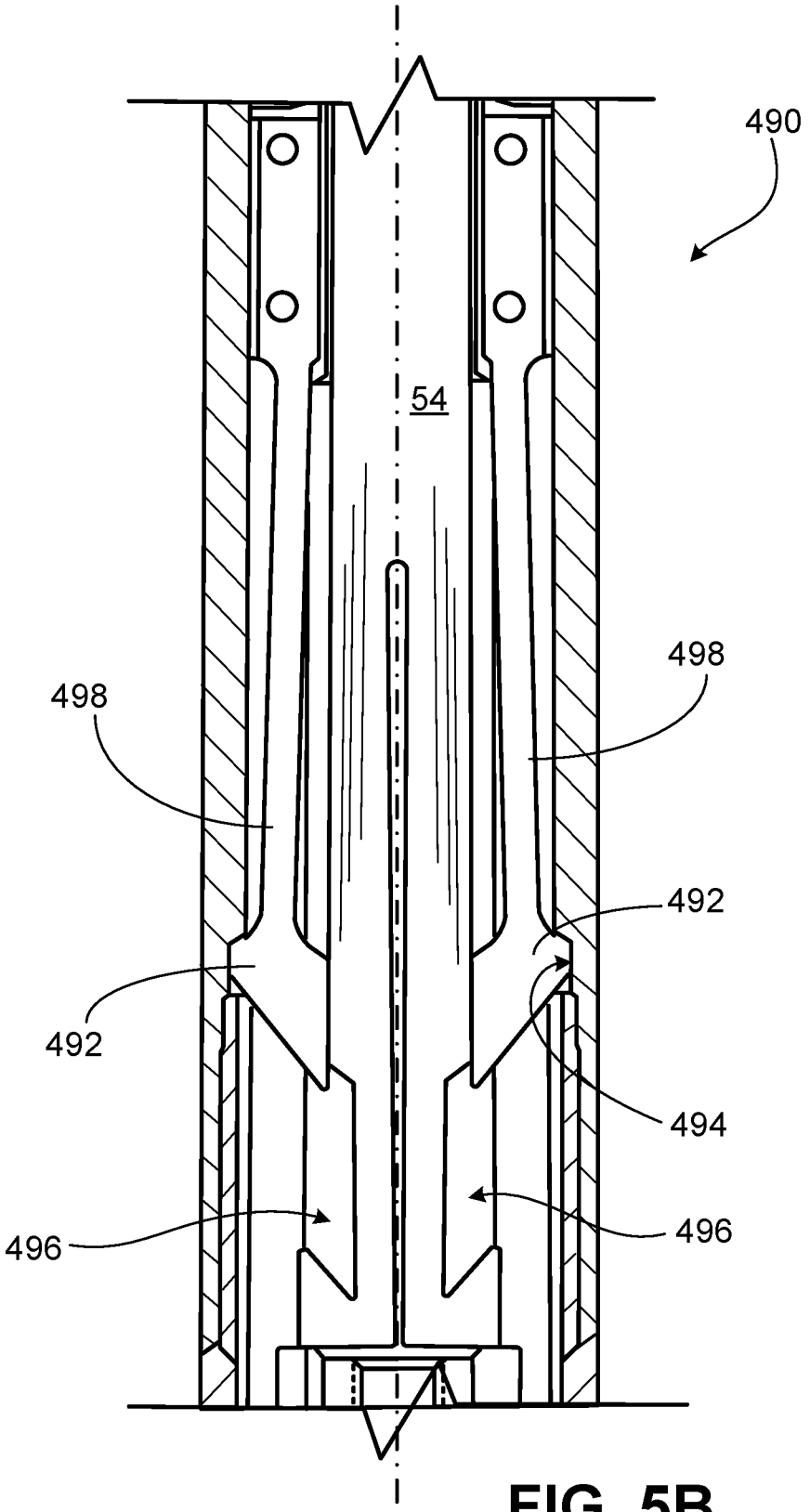
FIG. 5B is a cross-sectional side view of an example locking tool including a retractable latch key.

For example, FIG. 5B is a cross-sectional side view of an example locking tool 490 including a retractable latch key 492 engaged with a recess 494 of a well completion. The example locking tool 490 can be used in the recirculation isolator 404 of FIG. 4A, for example, as an axial anchoring feature and/or rotational locking feature. The latch key 492 is configured to reside in an inner recess 496, for example during a run in of the locking tool 490 into a well, and activated to radially extend out of the inner recess 496 to a radially outward position, as shown in FIG. 5B, to engage the recess 494 of the well completion. The retractable latch key 492 can be activated to reside in the inner recess 496 or extend radially outward toward the recess 494 using an activation method described earlier. For example, a latch finger 498 coupled to the latch key 492 can be activated to translate relative to a housing of the locking tool 490 to retract (into the inner recess 496) or radially extend (toward the recess 494) the latch key.

The locking tool of the recirculation isolator 404 can include any combination of example axial positioning features, rotational locking features, and anchoring features described herein. In some instances, the order in which the features of the locking tool are operated can promote a more reliable positioning and operation of the retrievable string 400. For example, the locking tool can operate to first engage a rotational locking feature of the locking tool with the completion string to rotationally lock the retrievable string 404 to the completion string; for example, the locking tool can engage a radial key of the recirculation isolator with an indexing receptacle of the completion string. The locking tool can then operate to secondly engage an axial positioning feature (e.g., a no-go shoulder, retractable key, magnetic sensor, or other example axial positioning feature) with the completion string to axially position the recirculation isolator 404 in the completion string. The locking tool can then operate to thirdly engage an anchoring feature (e.g., no-go shoulder, slip plates, retractable keys, or other example anchoring feature) with the completion string to axially lock the recirculation isolator 404 to the completion string. In some implementations, the locking tool of the recirculation isolator 404 engages the rotational locking feature first, the axial positioning feature second, and the anchoring feature third. In certain instances, the locking tool of the recirculation isolator 404 can simultaneously engage two of or all of the rotational locking feature, the axial positioning feature, or the anchoring feature. For example, the locking tool can simultaneously axially positions and anchors the recirculation isolator 404, simultaneously axially positions and rotationally locks the recirculation isolator 404, simultaneously rotationally locks and anchors the recirculation isolator 404, or simultaneously axially position, rotationally lock, and anchor the recirculation isolator 404.

In some instances, the rotational locking feature of the locking tool of the recirculation isolator 404 includes a key, key way, or similar structure to position the recirculation isolator 404 in the completion string prior to the axial positioning feature engaging the completion string. The completion string can include an order of corresponding profiles for the rotational locking feature, axial positioning feature, and/or anchoring feature such that as the retrievable string is deployed downhole, the desired (predetermined) order of engagement of the features of the locking tool is implemented. For example, as the retrievable string 400 is deployed and lowered downhole, a key of the rotational locking feature begins to engage a keyway (tapered, straight, or otherwise) of the completion string prior to an axial positioning feature and/or anchoring feature engages corresponding profiles of the completion string. The keyway can extend along a length of the completion string (e.g., landing sub) a sufficient length to engage the key of the rotational locking tool and allow for sufficient axial length to have the axial positioning feature and anchoring feature engage with respective portions of the completion string.

The sealing features of the recirculation isolator 404 are configured to create a seal between the non-rotating portion 420 and the subsystem 300 and/or production tubing 128. By creating the seal between the non-rotating portion 420 and the subsystem 300 and/or production tubing 128, the recirculation isolator 404 can force produced fluid to flow through the space between the impellers 432 and the non-rotating portion 420 (e.g., housing) of the pump and also prevent discharged fluid from recirculating upstream (in the context of a vertical production well, upstream can be understood to mean downhole) through the annulus between the retrievable string 400 and the subsystem 300 and/or production tubing 128. The seal prevents (substantially or completely) produced fluids exiting the uphole end of the recirculation isolator 404 from flowing back to the intake of the pump through the annular space between the pump housing and the well completion (i.e., production tubing 128, subsystem 300, and/or landing sub 304). In some implementations, the sealing features includes one or more sealing elements on the recirculation isolator 404 configured to radially extend and engage the well completion to create the seal between the recirculation isolator 404 and the well completion. The sealing element(s) can be formed of varying materials, such as a rubber polymer like nitrile butadiene rubber (NBR), Viton, or other polymer. The recirculation isolator 404 can include a packer, a bridge plug, a tubing pack-off, or other structure that includes the sealing element.

In some instances, the sealing feature of the recirculation isolator 404 includes a labyrinth seal. The housing 434 of the pump (or other housing portion of the recirculation isolator 404) can have an outer diameter that approaches the inner diameter of the subsystem 300 or production tubing 128. This small clearance between the recirculation isolator 404 and the well completion (i.e., subsystem 300, production tubing 128, or both) minimizes the flow path for returning fluid, and in some instances, includes abradable sections that can act as seals on the outer diameter of the recirculation isolator 404. The abradable sections can include an abradable material, frangible material, or other material that can engage with an inner diameter of the production tubing 128 or subsystem 300, and provide a low pressure seal between the recirculation isolator 404 and the well completion. The labyrinth seal can minimize the pressure differential locally at each or multiple stages of the pump of the retrievable string 400, and can provide a tortuous return path of fluid from the outlet of the pump to the inlet of the pump to reduce fluid recirculation. In some examples, the abradable sections include a ring of abradable material that can engage the inner diameter of the well completion to provide a seal, but can also at least partially break down and reduce in diameter to allow translation along the well completion and fit within the inner diameter of the well completion, for example, in response to jarring or other movement of the recirculation isolator 404 to degrade or reduce the outer diameter of the abradable material. The abradable material can take many forms and include a variety of materials, such as Fluorosint®, Si—Al graphite, Ni-graphite, Al—Si-polyester, a combination of these, or other materials. The abradable material can act as a sealing feature of the recirculation isolator 404, and can be a primary, secondary, or redundant sealing feature of the recirculation isolator 404. In some implementations, the recirculation isolator 404 can include an anti-rotation feature (examples described earlier) to prevent or reduce relative rotation between the pump housing (e.g., housing 434 or recirculation isolator 404) and the production tubing 128, and can include an axial stop to support the pump housing on the well completion.

The retrievable string 400 is retrievable, in that the string 400 can be run into the well, set in place, operated to provide assisted fluid flow, unseated, and retrieved from the well. The conveyance and retrieval features, axial indexing features, anchoring features, anti-rotation features, and/or sealing features can be activated (e.g., set, expanded, or otherwise activated) and subsequently deactivated (e.g., unset, retracted, or otherwise deactivated), for example, by manipulation of the cable 202 (e.g., jarring up or down on the running tool 408 with the cable 202) or with a setting tool of the running tool 408 or running feature connection 406.

Figure 4B:
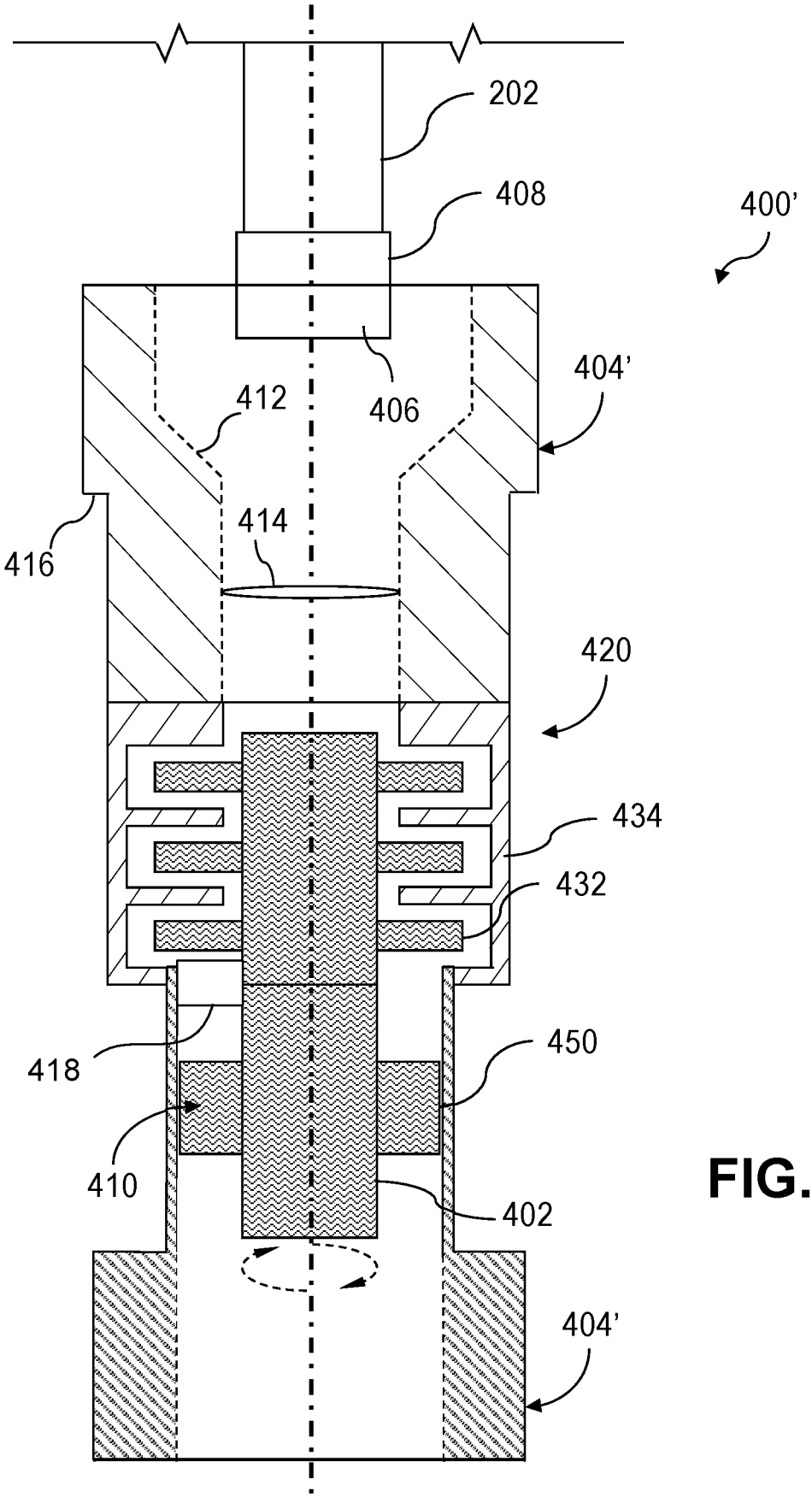
FIG. 4B is a schematic partial cross-sectional side view of an example retrievable string of the system of FIG. 2.

FIG. 4A shows the recirculation isolator 404 as disposed only uphole of the pump. However, the recirculation isolator 404 can extend elsewhere on the retrievable string 400. For example, FIG. 4B is a schematic partial cross-sectional side view of a retrievable string 400' with a recirculation isolator 404'. The retrievable string 400' and recirculation isolator 404' are the same as the retrievable string 400 and recirculation isolator 404 of FIG. 4A, except the recirculation isolator 404' further extends downhole of the pump and the rotor 402, for example, to provide axial indexing features, anchoring features, anti-rotation features, and/or sealing features at a location downhole of the pump and rotor 402. In some implementations, the rotor 402 can be separable such that the motor portion of the rotor 402 (for example, the portion of the rotor 402 with the permanent magnet 450) can be removably coupled to the pump portion (for example the portion of the rotor 402 with the impellers 432). Similarly, the recirculation isolator 404' can be split such that a first portion of the recirculation isolator 404' couples to the motor portion and a second portion of the recirculation isolator 404' couples to the pump portion. In some examples, the motor portion and the first portion of the recirculation isolator 404' is separately deployable in the well, and can selectively lock to the well completion with a first set of locking features; the pump portion and the second portion of the recirculation isolator 404 can subsequently be deployed in the well, and can selectively lock to the motor portion and the first portion of the recirculation isolator 404', and selectively locks to the well completion with a second set of locking features. The motor portion can have a separate deployment and locking operation, with a subsequent deployment and locking operation of the pump portion that engages the same or different feature of the well completion and connects to the motor portion rotor.

Figure 5C:
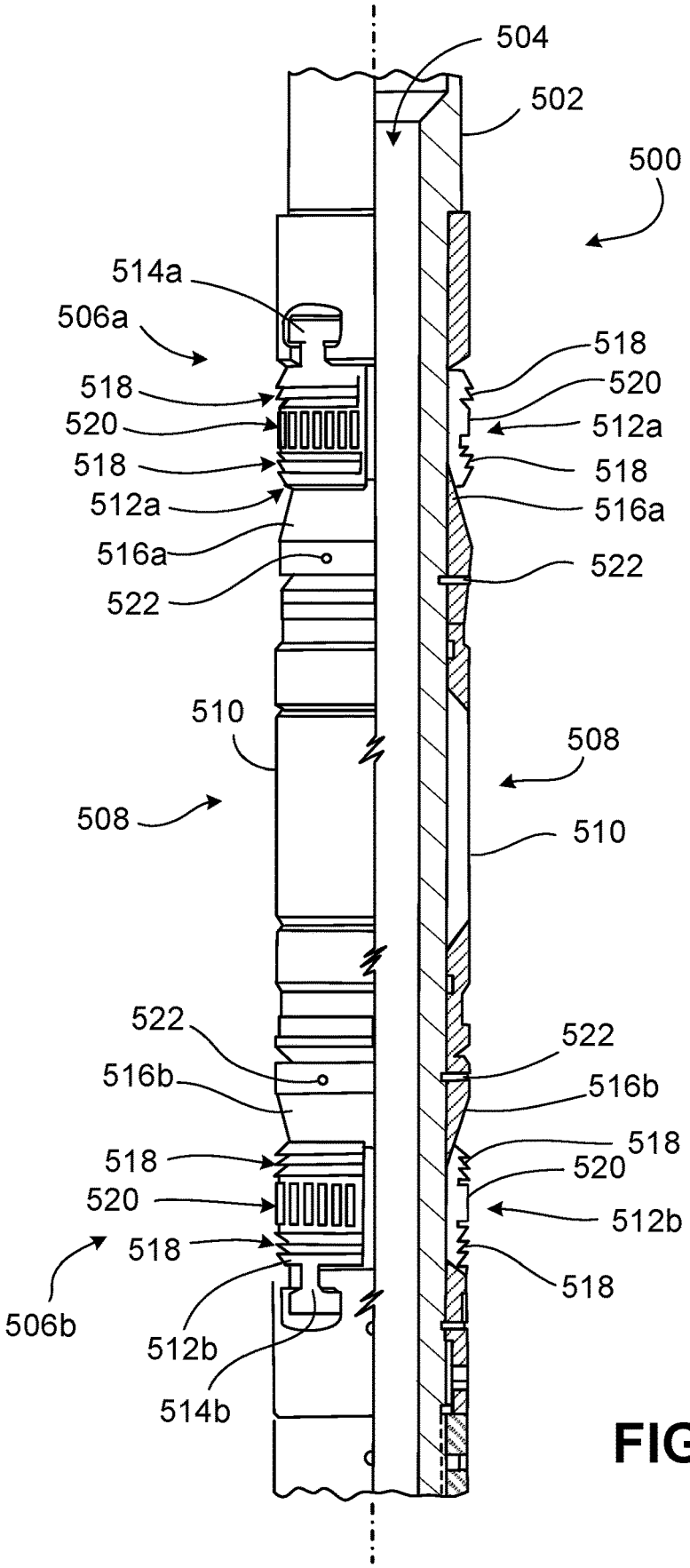
FIG. 5C is a half cross-sectional side view of an example locking tool that can be incorporated into the retrievable string of FIG. 4A or FIG. 4B.

In some implementations, the anchoring feature of the recirculation isolator 404 can also act to rotationally lock, axially index, and/or seal the recirculation isolator 404 relative to the well completion. In some examples, the recirculation isolator 404 includes an anchor with mechanical slips that can stab into an inner diameter of the well completion (such as the stator 302 or the production tubing 128) to provide rotational and/or axial locking of the recirculation isolator 404 in the well completion. For example, FIG. 5C is a half cross-sectional side view of an example locking tool 500 that can be incorporated into the recirculation isolator 404 of FIG. 4A and/or the recirculation isolator 404' of FIG. 4B. The example locking tool 500 can provide rotational locking, axial anchoring, and sealing to a recirculation isolator. The example locking tool 500 includes a housing 502, a central bore 504 to allow fluid flow through the locking tool 500, a first anchor slip assembly 506*a*, a second anchor slip assembly 506*b*, and a seal assembly 508 having a seal element 510 configured to radially expand, for example, to engage and seal to the well completion. The first anchor slip assembly 506*a* and the second anchor slip assembly 506*b* includes a first slip plate 512*a* and a second slip plate 512*b*, respectively, configured to expand radially outward to engage a surface of the well completion. The anchor slip assemblies 506*a* and 506*b* include a first radial guide (e.g., channel) 514*a* and second radial guide 514*b*, respectively, to guide movement of the slip plates 512*a* and 512*b* in a radial direction. The slip plates 512*a* and 512*b* sit adjacent to and contact wedges 516*a* and 516*b*, respectively, such that a translation of the wedges 516*a* and 516*b* relative to the slip plates 512*a* and 512*b* drive the slip plates to extend radially outward along the radial guides 514*a* and 514*b*. Each of the slip plates 512*a* and 512*b* include horizontal teeth 518 and vertical teeth 520, for example, to dig into the surface of the well completion when expanded radially outward to lock the locking tool 500 both vertically (i.e., axially) and horizontally (i.e., rotationally).

The locking tool 500 can set the seal element 510 of the seal assembly 508, the first slip plate 512*a*, and the second slip plate 512*b* by a setting force acting on the elements of the locking tool 500 in an axial direction. For example, jarring the locking tool 500 (e.g., using the cable 202 and running tool 408 of FIGS. 4A and 4B), can break a frangible lock (e.g., shear pins 522) of the locking tool 500 to compress and radially expand the seal element 510, and outwardly move the first slip plate 512*a*, and second slip plate 512*b* to engage the well completion. The seal element 510 provides a seal at the recirculation isolator, and the first slip plate 512*a* and second slip plate 512*b* provide axial anchoring and rotational locking of the recirculation isolator relative to the well completion.

Figure 5D:
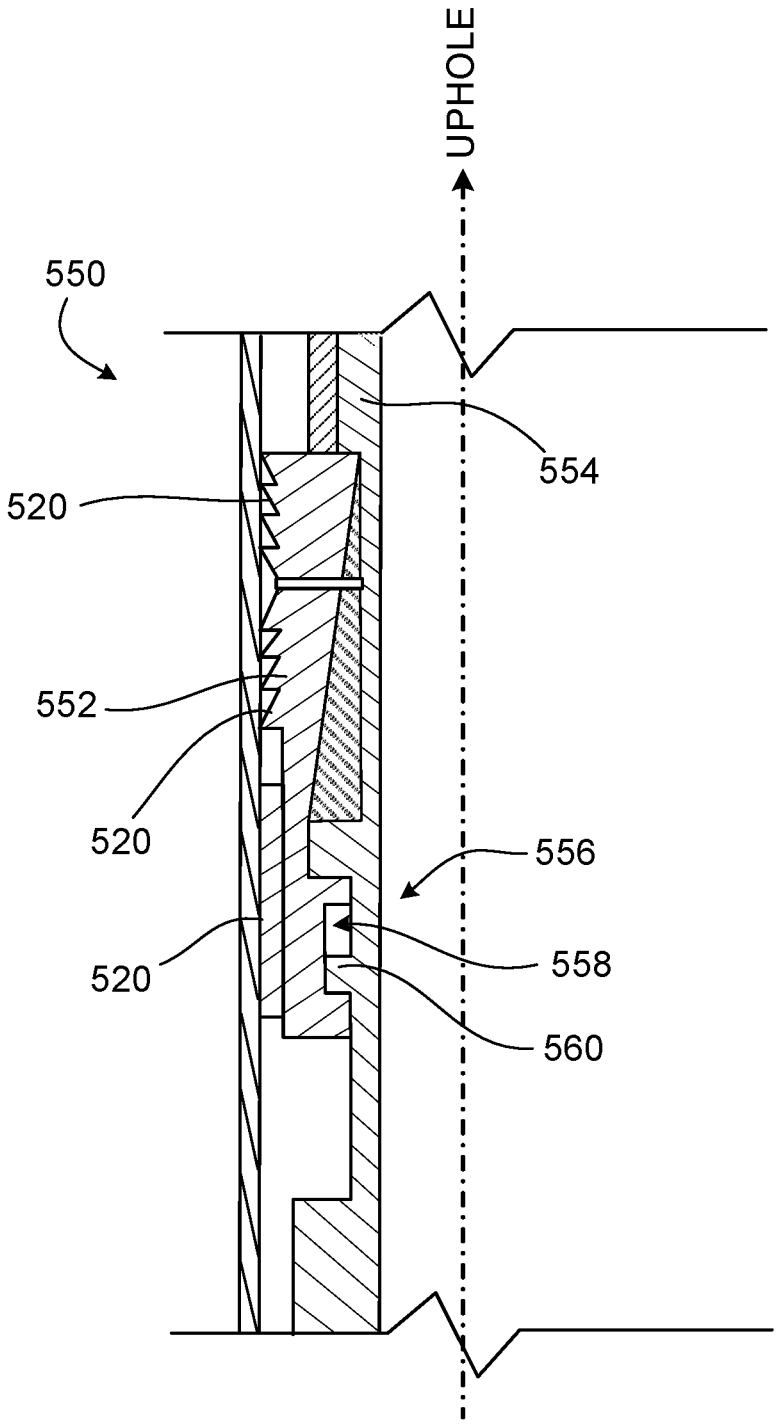
FIG. 5D is a partial cross-sectional side view of an example locking tool with a slip plate that can be incorporated into the example locking tool of FIG. 5C.

In some implementations, slip plates of a locking tool (e.g., slip plates 512*a* and 512*b* of locking tool 500 of FIG. 5C) includes a rotational guide structure, for example, to rotationally lock the slip plate while allowing for axial (e.g., longitudinal) movement of the slip plate. FIG. 5D is a partial cross-sectional side view of an example locking tool 550 with a slip plate 552 connected to a housing 554 with a rotational guide structure 556. The rotational guide structure 556 includes a longitudinal (i.e., vertical) channel 558 at a radially inward surface of the slip plate 552 that engages with a protruding key 560 in the housing 554. The protruding key 560 fits within the vertical channel 558 to substantially prevent lateral (i.e., rotational) movement of the slip plate 552 relative to the housing 554 while allowing longitudinal (i.e., axial) movement of the slip plate 552 relative to the housing 554. The example locking tool 550 can be used in the locking tool 500 of FIG. 5C, for example, to rotationally lock the slip plates 512*a* and 512*b*.

In some implementations, multiple retrievable strings 400 can be deployed to act together or independently to provide higher output or redundancy to enhance long-term operation.

Figure 6:
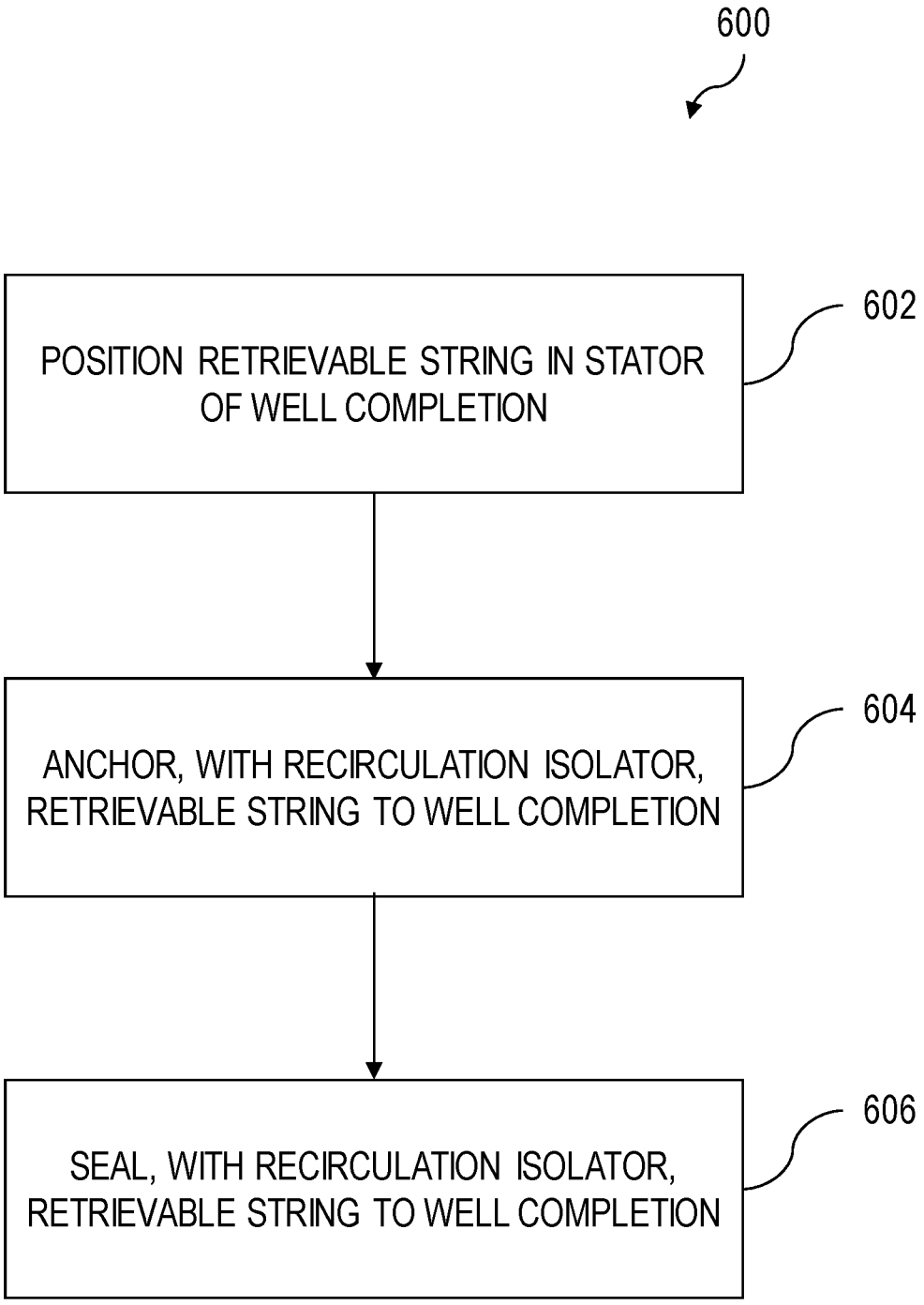
FIG. 6 is a flow chart of an example method applicable to a system including a stator and a retrievable string.

FIG. 6 illustrates steps of a method 600 as a flow chart. At step 602, a retrievable string (such as the retrievable string 400) is positioned in a stator (such as the stator 302) of a completion string (well completion) installed in a well (such as the well 100). The retrievable string 400 can be positioned in the stator 302 such that the various corresponding components are aligned with each other. For example, the electromagnetic coil 350 of the stator 302 is aligned with the motor permanent magnet 450 of the retrievable string 400. As described previously, the retrievable string 400 includes a rotating portion 410 and a non-rotating portion 420. The rotating portion 410 includes a rotor (such as the rotor 402) and an impeller (such as the impeller 432) coupled to the rotor 402. In some implementations, although the impeller 432 is part of the rotating portion 410 of the retrievable string 400, the impeller 432 resides within the non-rotating portion 420 of the retrievable string 400. As described previously, the retrievable string 400 can include at least one of an electric submersible pump, a compressor, or a blower.

In some implementations, the stator 302 is installed as part of the completion string in the well 100 before the retrievable string 400 is positioned in the stator 302. In some implementations, an annulus between the stator 302 and the well 100 (such as the inner bore 116 between the casing 112 and the production tubing 128) is filled with a completion fluid, which includes a corrosion inhibitor.

In some implementations, positioning the retrievable string 400 in the stator 302 of the well completion includes running the retrievable string 400 into the well using a cable 202 and running tool 408 coupled to a running feature connection 406 of the recirculation isolator 404 of the retrievable string 400, or applying fluidic pressure on a plug of the recirculation isolator 404 at an uphole end of the retrievable string 400 (this deployment method is sometimes referred to as a "pump down" method). In certain implementations, positioning the retrievable string 400 includes axially indexing the retrievable string 400 in the well completion with axial indexing features of the recirculation isolator 404 engaging a landing sub 304 or other component of the well completion.

At step 604, the recirculation isolator 404 of the retrievable string 400 anchors the retrievable string 400 to the well completion (completion string). The recirculation isolator 404 can include one or more anchoring features or rotational locking features to anchor the retrievable string 400 to the well completion. The stator 302 can then be used to drive the rotor 402 of the retrievable string 400 to rotate the impeller 432.

At step 606, the recirculation isolator 404 of the retrievable string 400 seals the retrievable string 400 to the well completion. The recirculation isolator 404 can include one or more sealing features (e.g., expandable sealing element, packer, bridge plug, or other) to seal the retrievable string 400 to the well completion.

In some implementations, the stator 302 includes an electromagnetic coil (such as the electromagnetic coil 350), and the retrievable string 400 includes a motor permanent magnet (such as the motor permanent magnet 450) coupled to the rotor 402. A magnetic field can be generated by the electromagnetic coil 350 of the stator 302 to engage the motor permanent magnet 450 of the retrievable string 400, causing the rotor 402 (and the impeller 432) to rotate. The rotating impeller 432 induces fluid flow within the well 100. In some implementations, one or more properties (such as a property of the well 100, a property of the stator 302, and a property of the retrievable string 400) are determined by a sensor of the stator 302. Various operating parameters can then be adjusted based on the one or more determined properties. For example, the operating speed (rotation speed of the rotor 402) can be adjusted. The one or more determined properties can be used to determine shutdown or impending maintenance issues. The one or more determined properties can be used to assess changes in production fluid properties. The one or more determined properties can be used to assess changes in well characteristics over time.

The stator 302 can include an actuator (such as a thrust bearing actuator or radial bearing actuator), and the retrievable string 400 can include a bearing target (such as a thrust bearing target or radial bearing target). In some implementations, the bearing target includes a bearing permanent magnet. A mechanical load on the rotor 402 can be counteracted by generating a magnetic field using the actuator to engage the bearing target. In some implementations, the mechanical load on the rotor 402 is an axial (thrust) load on the rotor 402. In some implementations, the mechanical load on the rotor 402 is a radial load on the rotor 402. The stator 302 can include additional actuators, and the retrievable string 400 can include additional bearing targets. In some implementations, one or more of the actuators and one or more of the bearing targets are cooperatively configured to counteract axial loads on the rotor 402, while the remaining actuators and the remaining bearing targets are cooperatively configured to counteract radial loads on the rotor 402. Each of the actuators can be one of a thrust bearing electromagnetic coil, a radial bearing electromagnetic coil, a thrust bearing permanent magnet, and a radial bearing permanent magnet.

In the case that the retrievable string 400 requires maintenance, the retrievable string 400 can be decoupled from the completion string and retrieved from the well 100. While the retrievable string 400 is decoupled from the completion string and retrieved from the well 100, the stator 302 can remain in the well 100. The retrievable string 400 can undergo maintenance and be re-deployed in the well 100. In some implementations, another retrievable string (the same as or similar to the retrievable string 400) can be deployed in the well after the retrievable string 400 is positioned in and coupled to the well completion.

In some implementations, during deployment of the retrievable string 400, cable 202 (e.g., a slickline) with the running tool 408 connects to the running feature connection 406 on the uphole longitudinal end of the recirculation isolator 404 to lower the retrievable string 400 into the well 100. As the retrievable string 400 is lowered into the production tubing 128 by the cable 202 and reaches the desired, predetermined depth, the indexing features on the recirculation isolator 404 engage with the corresponding indexing features on the landing sub 304 (or other structure) of the well completion. Once the indexing features are fully engaged and the retrievable string 400 is set, the running tool 408 can disengage with the recirculation isolator 404, for example, by manipulating (e.g., pulling or releasing with the facilitation of jarring up or down to shear a frangible element, e.g. shear pin, and/or activate a mechanism) the cable 202 to retrieve the cable 202 and the running tool 408 back to the surface 106 and leave the retrievable string 400 in the well 100. Once the running tool 408 is disengaged from the running feature connection 406 of the recirculation isolator 404, a pulling feature (e.g., the running feature connection 406) on the longitudinal uphole end of the recirculation isolator 404 is exposed for engagement of a pulling tool (e.g., running tool 408) during retrieval. The retrievable string 400 axially aligns (longitudinally along the production tubing 128) with the permanent completion or well completion. In this case, the motor and bearing magnets 450 on the retrievable string 400 also axially align with their corresponding motor and bearing stator coils 350.

In some implementations, when the retrievable string 400 is set, the anchoring features on the recirculation isolator 404 engage with corresponding features on the landing sub 304. In this case, the anchoring features can prevent either the uphole or downhole axial movements of the retrievable string 400 relative to the permanent completion or well completion by external forces.

In some implementations, when the retrievable string 400 is set, the anti-rotation features on the recirculation isolator 404 engage with the corresponding features on the landing sub 304. In this case, the anti-rotation features can prevent the recirculation isolator 404 and the pump stator from rotating when the motor is rotating the pump rotor so that the recirculation isolator 404 and the pump stator are both axially aligned and radially fixed with the permanent completion or well completion.

In some implementations, during normal operation of the retrievable string when the motor is rotating the pump rotor, the recirculation isolator 404 allows the produced fluids to flow from the pump outlet through the check valve 414 of the recirculation isolator 404 into the production tubing 128 uphole of the recirculation isolator 404. In the meantime, the recirculation isolator 404 includes sealing features with a sealing element on its radially outward diameter to seal against the inside diameter of the corresponding sealing bore of the landing sub 304 (or other feature) of the well completion, to prevent the produced fluids at the top of the recirculation isolator 404 to flow back to the intake of the pump through the clearance between the pump housing and the production tubing 128.

In some implementations, before start-up or during shutdown of the retrievable string 400 when the motor has stopped rotating the pump rotor, the check valve 414 inside the recirculation isolator 404 restricts fluids and solids on the top of the recirculation isolator 404 from flowing back into the pump. In this case, solids will not settle and fill the pump during well shut-in so that the pump can be restarted without problems caused by solids.

In some implementations, during retrieval of the retrievable string 400, the cable 202 with a pulling tool (e.g., running tool 408) is lowered into the well 100. The pulling tool can engage with the pulling features (e.g., running feature connection 406) on the longitudinally uphole end of the recirculation isolator 404. Once pulling features are fully engaged and the retrievable string 400 is ready to be unset, the recirculation isolator 404 can disengage with the landing sub 304 (and/or other features) of the well completion by manipulating (e.g., pulling or releasing with the facilitation of jarring up or down to shear a frangible element, e.g. shear pin, and/or activate a mechanism) the cable 202 to allow the indexing features, anchoring features, anti-rotational features, and sealing features of the recirculation isolator 404 to disengage with their corresponding features on the landing sub 304 and/or other portions of the well completion. The retrievable string 400 can then be retrieved from the well 100, for example, back to the surface 106.

Figure 7A:
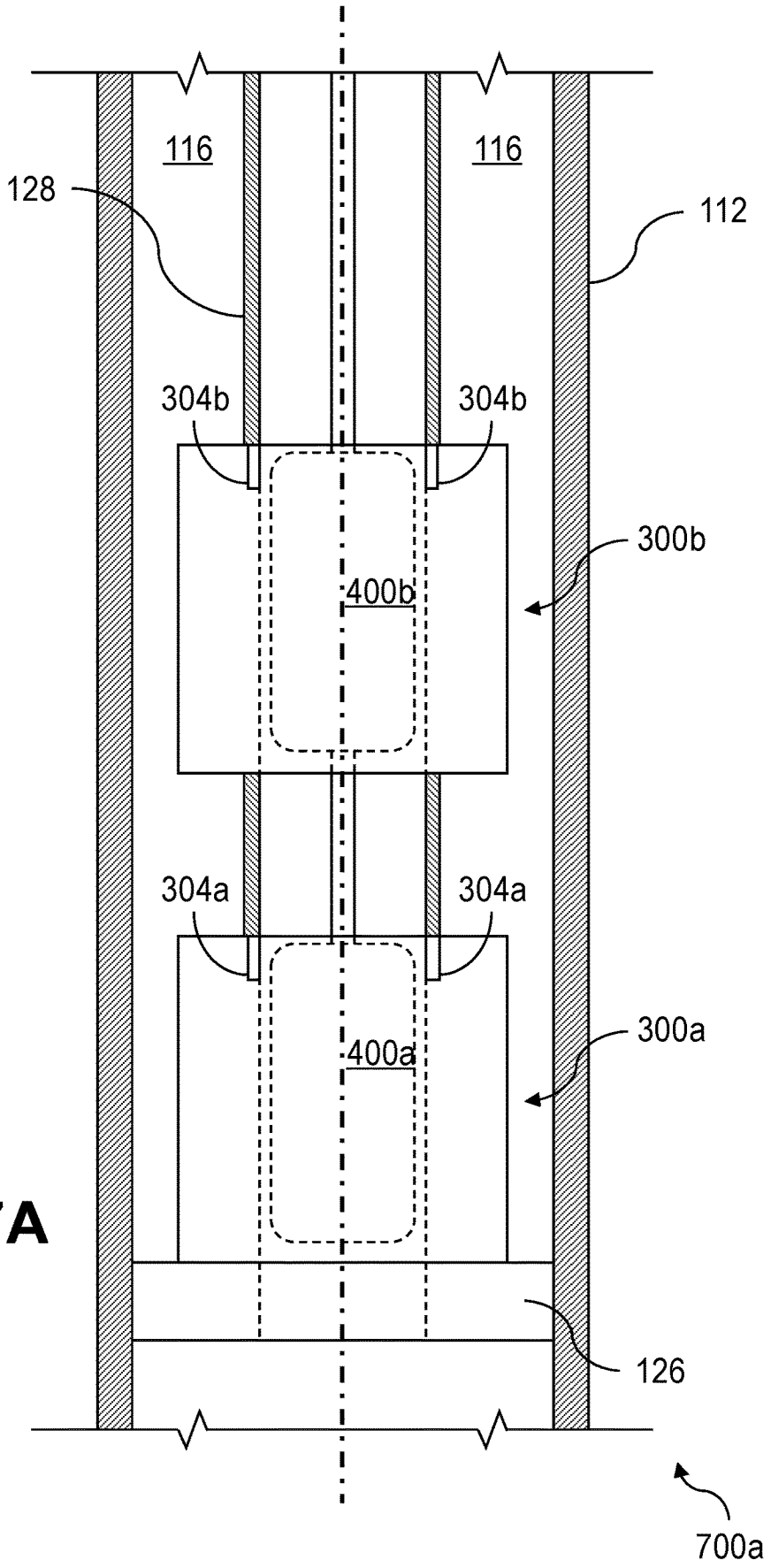
FIGS. 7A, 7B, 7C, and 7D are schematic partial cross-sectional diagrams of example systems within the well of FIG. 1.

Referring to FIG. 7A, the system 700*a* of FIG. 7A includes a first subsystem 300*a* and a second subsystem 300*b*, separate from each other and positioned at different locations along the production tubing 128. The first subsystem 300*a* and the second subsystem 300*b* can include any of the components that were previously described with respect to the subsystem 300. In some implementations, the first subsystem 300*a* and the second subsystem 300*b* are substantially the same (that is, they include the same components). The system 700*a* includes a first retrievable string 400*a* and a second retrievable string 400*b*. The first retrievable string 400*a* can be positioned within the first subsystem 300*a*, and the second retrievable string 400*b* can be positioned within the second subsystem 300*b*. The first retrievable string 400*a* and the second retrievable string 400*b* can include any of the components that were previously described with respect to the retrievable string 400 or 400'. In some implementations, the first retrievable string 400*a* and the second retrievable string 400*b* are substantially the same. The first subsystem 300*a* and the first retrievable string 400*a* can be coupled together with a landing sub 304*a* of the first subsystem 300*a* and a corresponding recirculation isolator of the first retrievable string 400*a*. The first subsystem 300*a* and the first retrievable string 400*a* can co-operate to induce fluid flow within the well. The second subsystem 300*b* and the second retrievable string 400*b* can be coupled together with a second landing sub 304*b* of the second subsystem 300*b* and a corresponding recirculation isolator of the second retrievable string 400*b*. The second subsystem 300*b* and the second retrievable string 400*b* can co-operate to induce fluid flow within the well.

Figure 7B:
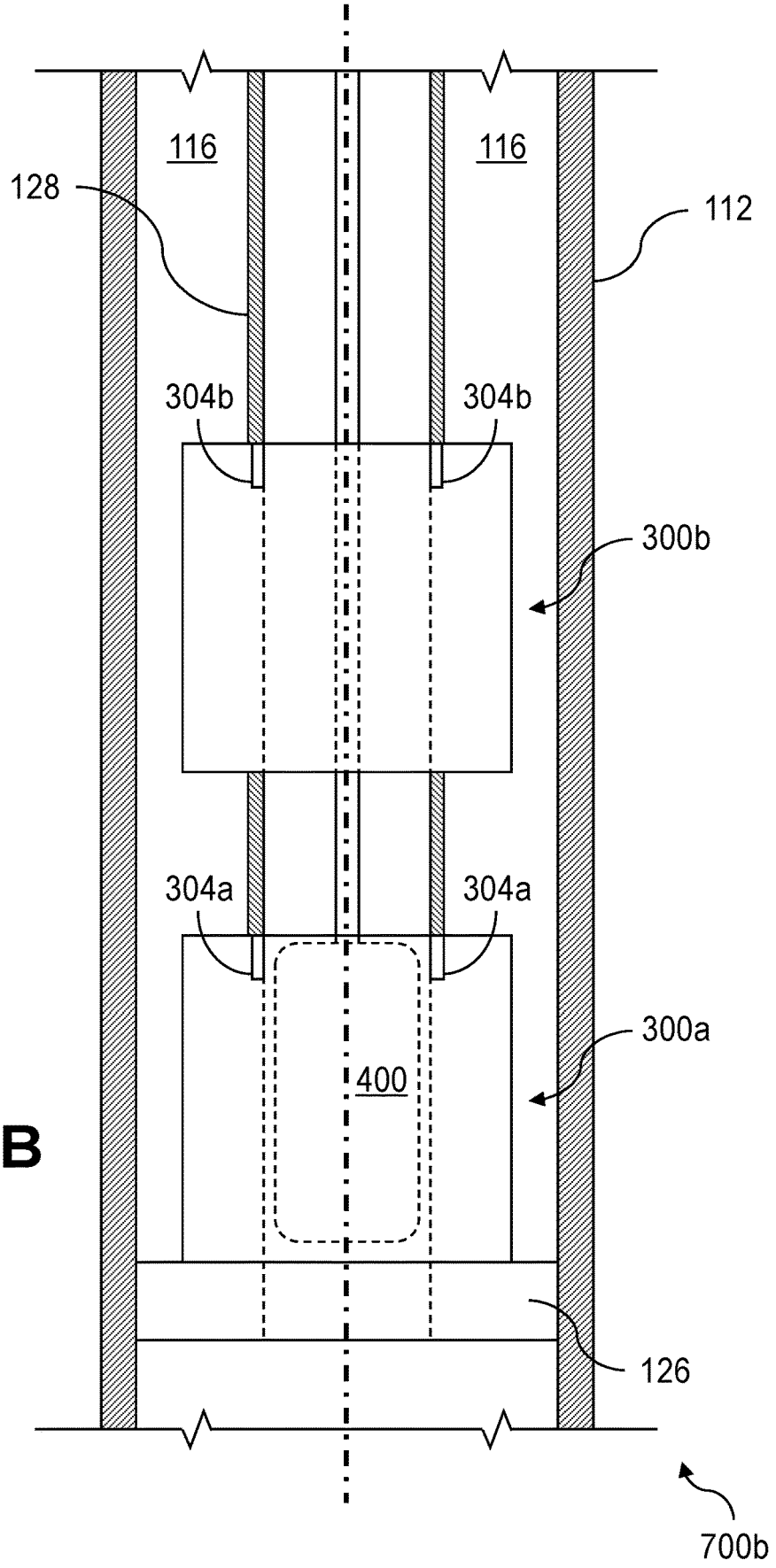

The system 700*b* of FIG. 7B is substantially similar to the system 700*a*. The retrievable string 400 of system 700*b* can co-operate with either the first subsystem 300*a* or the second subsystem 300*b* to induce fluid flow within the well. For example, the retrievable string 400 can be positioned within and coupled to the first subsystem 300*a* with the landing sub 304*a* and the recirculation isolator of the retrievable string 400. The retrievable string 400 can co-operate with the first subsystem 300*a* to induce fluid flow at a first location within the well (for example, at the location of the first subsystem 300*a*). The retrievable string 400 can be de-coupled from the first subsystem 300*a* and positioned within and coupled to the second subsystem 300*b* with the second landing sub 304*b* and the recirculation isolator of the retrievable string 400. The retrievable string 400 can co-operate with the second subsystem 300*b* to induce fluid flow at a second location within the well (for example, at the location of the second subsystem 300*b*).

Figure 7C:
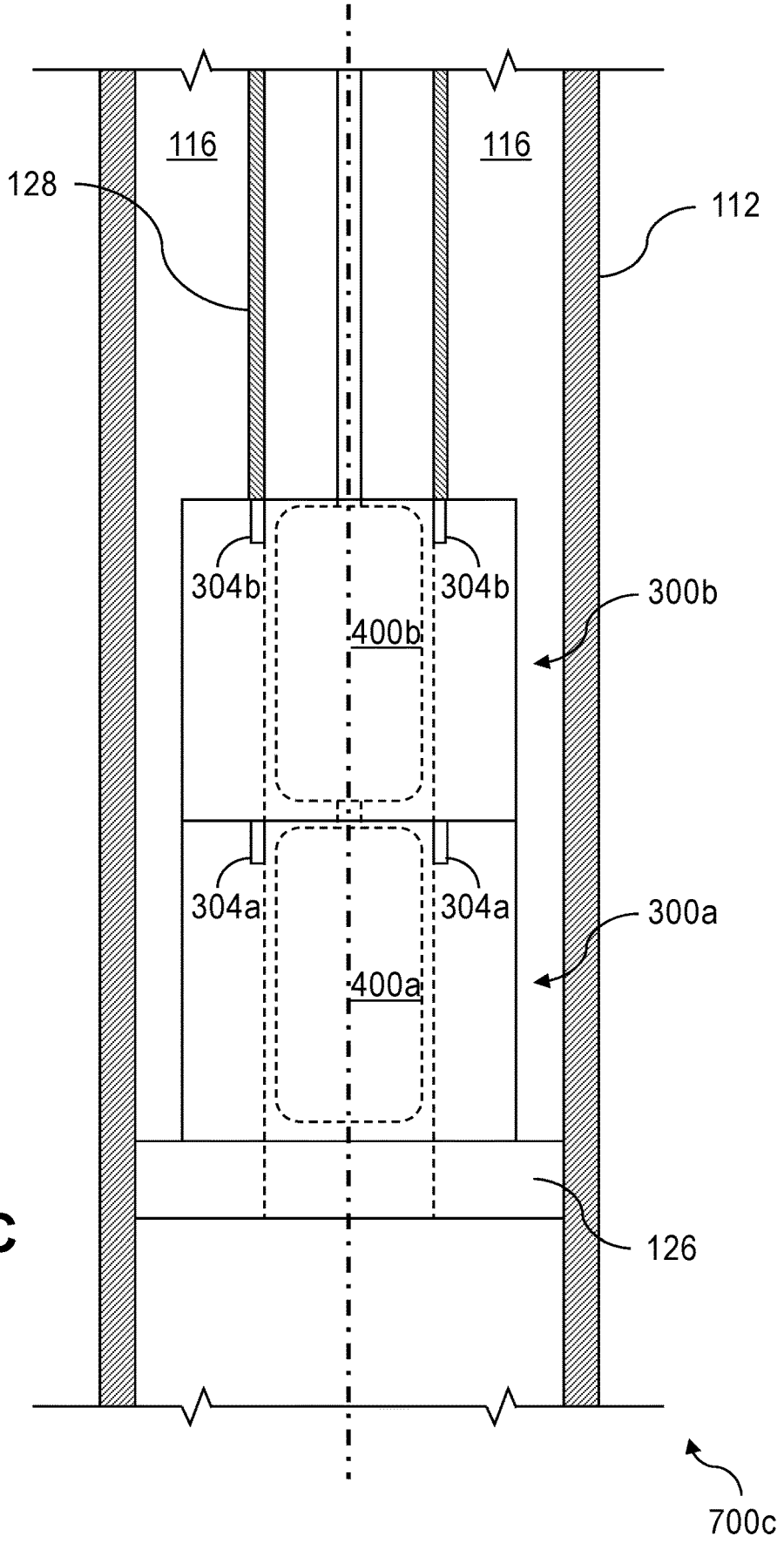
Figure 7D:
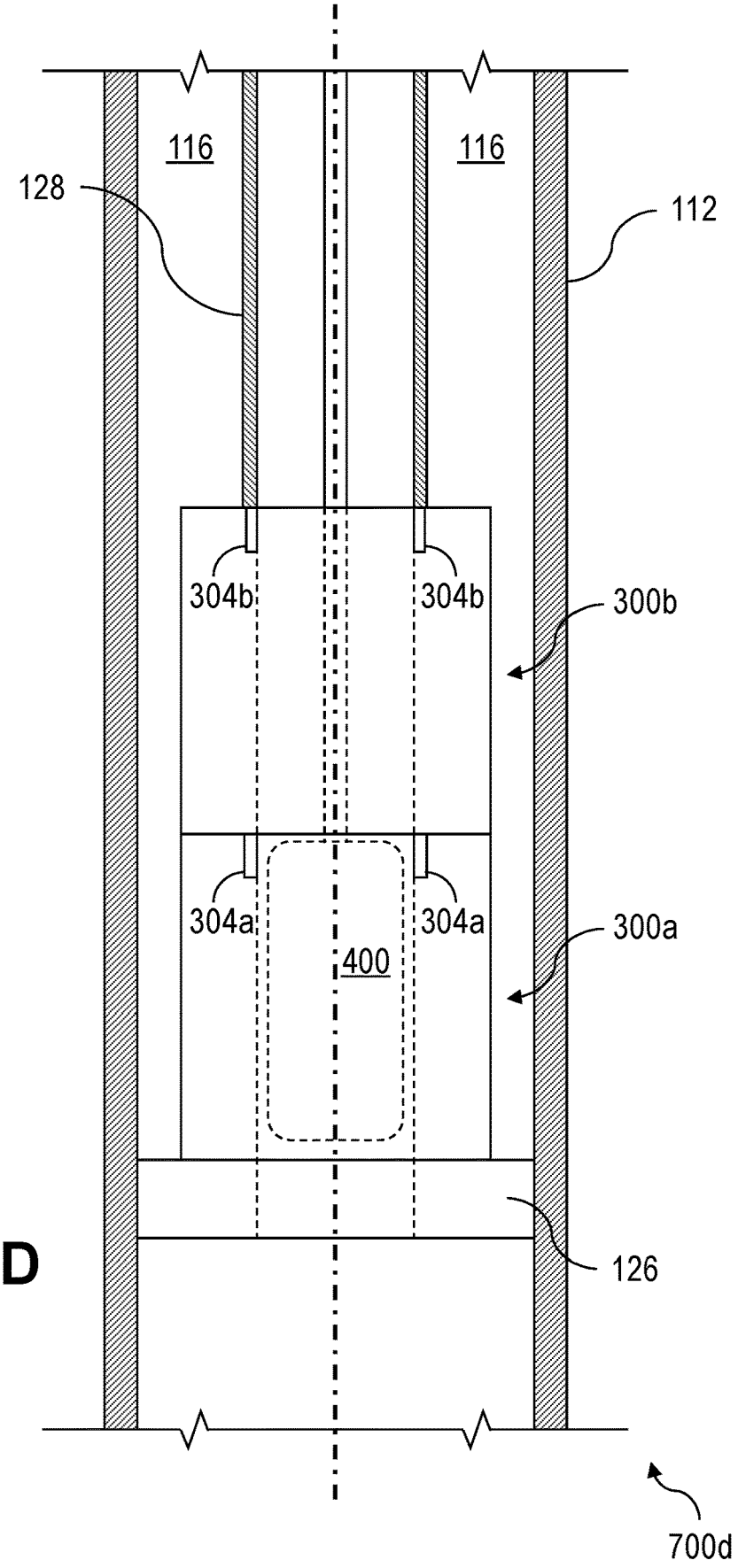

The system 700*c* of FIG. 7C is substantially similar to the system 700*a*, but the first subsystem 300*a* and the second subsystem 300*b* of system 700*c* are connected to each other. The system 700*d* of FIG. 7D is substantially similar to the system 700*b*, but the first subsystem 300*a* and the second subsystem 300*b* of system 700*d* are connected to each other. In such cases, the first subsystem 300*a* and second subsystem 300*b* together can be considered a single subsystem (for example, the subsystem 300). For example, the stator of the first subsystem 300*a* and the stator of the second subsystem 300*b* can each be considered sub-stators making up a single stator.

Although systems 700*a* and 700*c* are shown in FIGS. 7A and 7C (respectively) as having two subsystems (300*a*, 300*b*) and two retrievable strings (400*a*, 400*b*), the systems 700*a* and 700*c* can optionally include additional subsystems (for example, the same as or similar to the subsystem 300) and additional retrievable strings (for example, the same as or similar to the retrievable string 400), each of which can be either connected to each other or positioned at different locations in the well 100. Although systems 700*b* and 700*d* are shown in FIGS. 7B and 7D (respectively) as having two subsystems (300*a*, 300*b*) and one retrievable string (400), the systems 700*b* and 700*d* can optionally include additional subsystems (for example, the same as or similar to the subsystem 300) and additional retrievable strings (for example, the same as or similar to the retrievable string 400), each of which can be either connected to each other or positioned at different locations in the well 100.

In this disclosure, the terms "a," "an," or "the" are used to include one or more than one unless the context clearly dictates otherwise. The term "or" is used to refer to a nonexclusive "or" unless otherwise indicated. The statement "at least one of A or B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" can mean a deviation or allowance of up to 10 percent (%) and any variation from a mentioned value is within the tolerance limits of any machinery used to manufacture the part. Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise. "About" can allow for a degree of variability in a value or range, for example, within 10%, within 5%, or within 1% of a stated value or of a stated limit of a range.

While this disclosure contains many specific implementation details, these should not be construed as limitations on the scope of the subject matter or on the scope of what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A system for use in a completion string of a well, the completion string comprising an electrical stator, the system comprising:

a retrievable string configured to be disposed in the completion string of the well, the retrievable string comprising a rotor configured for receipt within the electrical stator and to rotate in response to electromagnetic fields generated by the stator, an impeller coupled to the rotor and positioned above the rotor relative to the position of the impeller in the well, a housing configured to surround the impeller, and a recirculation isolator coupled to the housing; and the recirculation isolator comprising a sealing element, a locking tool, and a plug proximate an uphole longitudinal end of the recirculation isolator, the sealing element configured to sealingly engage with the completion string, the locking tool configured to position the retrievable string in the completion string and detachably couple the retrievable string to the completion string, and the plug configured to at least partially seal against the completion string and urge the recirculation isolator along the completion string in response to an applied pressure against the plug;

where the locking tool comprises a rotational locking feature to engage an indexing receptacle of the completion string and rotationally lock the retrievable string in the completion string, an axial positioning feature to axially position the recirculation isolator in the completion string, and an anchoring feature to axially lock the recirculation isolator to the completion string.

2. The system of claim 1, wherein the retrievable string comprises a rotational lock between the housing and the rotor, the rotational lock configured to selectively rotationally lock the rotor to the housing.

3. The system of claim 1, wherein the rotational locking feature comprises a set of energized keys on the recirculation isolator configured to selectively extend and engage the indexing receptacle, the indexing receptacle comprising matching vertical slots in the completion string.

4. The system of claim 1, wherein the recirculation isolator comprises a packer, the packer comprising the sealing element configured to radially expand to engage and seal against the completion string.

5. The system of claim 1, wherein the recirculation isolator comprises a fluid channel through the recirculation isolator, the fluid channel configured to guide fluid flow from the impeller through the recirculation isolator.

6. The system of claim 5, wherein the recirculation isolator comprises a check valve in the fluid channel of the recirculation isolator to allow fluid flow in a first direction through the fluid channel and to restrict fluid flow in a second direction opposite the first direction through the fluid channel.

7. The system of claim 1, wherein the recirculation isolator comprises a running feature connection at a longitudinal end of the recirculation isolator, the running feature connection configured to selectively couple to a running tool.

8. The system of claim 1, wherein the locking tool comprises a first shoulder of the recirculation isolator, the first shoulder configured to land on and engage a second shoulder of the completion string at a predetermined depth of the completion string.

9. The system of claim 1, wherein the axial positioning feature of the recirculation isolator comprises a magnetic sensor configured to generate a voltage signal in response to aligning with a magnetic component of the completion string.

10. The system of claim 1, wherein the locking tool comprises a retractable key configured to selectively expand and retract in a radial direction, the retractable key configured to engage a locking profile of the completion string.

11. The system of claim 1, wherein the locking tool comprises a slip assembly comprising a slip plate configured to expand radially outward to engage a surface of the completion string.

12. The system of claim 11, wherein the slip plate comprises at least one of horizontal teeth or vertical teeth, the horizontal teeth configured to dig into the surface of the completion string to axially secure the slip plate to the completion string, and the vertical teeth configured to dig into the surface of the completion string to rotationally secure the slip plate to the completion string.

13. The system of claim 11, wherein the slip assembly comprises a radial guide configured to guide movement of the slip plate in a radial direction toward the surface of the completion string.

14. The system of claim 1, wherein the recirculation isolator comprises a second locking tool, where the first-mentioned locking tool is positioned at a first longitudinal side of the rotor and the second locking tool is positioned at a second longitudinal side of the rotor opposite the first longitudinal side.

15. The system of claim 1, further comprising the stator configured to attach to a tubing of the completion string, wherein the stator is configured to drive the rotor in response to receiving power.

16. The system of claim 15, wherein the retrievable string comprises a motor permanent magnet, and the system comprises an electromagnetic coil configured, in response to the electromagnetic coil receiving power, to generate a first magnetic field to engage the motor permanent magnet and cause the rotor to rotate.

17. The system of claim 1, wherein the retrievable string comprises a rotating portion and a non-rotating portion, where the rotating portion comprises the rotor and the impeller, and the non-rotating portion comprises the housing and the recirculation isolator.

18. A method, comprising:

at least partially sealing against a completion string with a plug of a recirculation isolator of a retrievable string, the plug disposed proximate an uphole longitudinal end of the recirculation isolator and configured to urge the recirculation isolator along the completion string in response to an applied pressure against the plug;

positioning, with a locking tool of the recirculation isolator of the retrievable string, the retrievable string in the completion string comprising an electrical stator, the retrievable string comprising a rotor configured for receipt within the electrical stator and to rotate in response to electromagnetic fields generated by the stator, an impeller coupled to the rotor, a housing configured to surround the impeller, and the recirculation isolator coupled to the housing; and anchoring, with the locking tool, the retrievable string to the completion string, where anchoring the retrievable string to the completion string comprises:

engaging, with a rotational locking feature of the locking tool, an indexing receptacle of the completion string to rotationally lock the retrievable string to the completion string, engaging, with an axial positioning feature of the locking tool, the completion string to axially position the recirculation isolator in the completion string, and engaging, with an anchoring feature of the locking tool, the completion string to axially lock the recirculation isolator to the completion string, and sealing, with a sealing element of the recirculation isolator, the retrievable string to the completion string.

19. The method of claim 18, wherein positioning the retrievable string in the completion string comprises landing a first shoulder of the locking tool of the recirculation isolator on a second shoulder of the completion string at a predetermined depth of the completion string.

20. The method of claim 19, wherein sealing the retrievable string to the completion string comprises setting a packer of the recirculation isolator to radially expand and engage the completion string, the packer comprising the sealing element.

21. The method of claim 18, wherein engaging, with a rotational locking feature, an indexing receptacle comprises selectively engaging, with a set of energized keys on the recirculation isolator, matching vertical slots of the indexing receptacle.

22. The method of claim 18, wherein anchoring the retrievable string to the completion string further comprises axially positioning the retrievable string in the completion string with the axial positioning feature of the recirculation isolator, and axially locking the retrievable string to the completion string with the anchoring feature of the locking tool.

23. The method of claim 22, wherein anchoring the retrievable string to the completion string comprises engaging a slip plate of a slip assembly of the locking tool with a surface of the completion string.

24. The method of claim 23, wherein engaging a slip plate of a slip assembly with a surface of the completion string comprises digging horizontal teeth of the slip plate into the surface of the completion string.

25. The method of claim 23, wherein engaging a slip plate of a slip assembly with a surface of the completion string comprises digging vertical teeth of the slip plate into the surface of the completion string.

26. The method of claim 18, further comprising:

unsealing the sealing element of the recirculation isolator with the completion string; and unsetting the locking tool from anchoring engagement with the completion string.

27. The method of claim 26, further comprising:

engaging, with a pulling tool carried on a cable, the recirculation isolator; and retrieving the retrievable string from the completion string.

28. A system for use in a well completion, the system comprising:

a production tubing string configured to be set in a wellbore to form a well completion, the production tubing string comprising a landing sub and an electrical stator disposed in the well completion, the landing sub comprising an indexing receptacle; and a retrievable string configured to be disposed in the production tubing string in the wellbore, the retrievable string comprising a rotor configured for receipt within the electrical stator and to rotate in response to electromagnetic fields generated by the stator, an impeller coupled to the rotor and positioned above the rotor relative to the position of the impeller in the production tubing string, and a recirculation isolator comprising a sealing element, a locking tool, and a plug proximate an uphole longitudinal end of the recirculation isolator, the sealing element configured to sealingly engage with the well completion, the plug configured to at least partially seal against the production tubing string and urge the recirculation isolator along the production tubing string in response to an applied pressure against the plug, and the locking tool configured to detachably couple to the landing sub to position, axially lock, and rotationally lock the retrievable string to the well completion, where the locking tool comprises a rotational locking feature to engage the indexing receptacle of the landing sub and rotationally lock the retrievable string to the landing sub, an axial positioning feature to axially position the recirculation isolator at the landing sub, and an anchoring feature to axially lock the recirculation isolator to the landing sub.

29. The system of claim 28, wherein the axial positioning feature of the recirculation isolator comprises a magnetic sensor configured to generate a voltage signal in response to aligning with a magnetic component of the production tubing string.

30. The system of claim 28, wherein the locking tool comprises a first shoulder of the recirculation isolator, and the landing sub comprises a second shoulder having a matching profile to the first shoulder, the first shoulder configured to land on and engage the second shoulder at a predetermined depth of the well completion.

31. The system of claim 28, wherein the locking tool comprises a slip assembly comprising a slip plate configured to expand radially outward to engage a surface of the landing sub.

32. The system of claim 28, wherein the rotational locking feature comprises a set of energized keys on the recirculation isolator, and the indexing receptacle comprises matching vertical slots in the completion string, the set of energized keys configured to selectively extend and engage one or more of the matching vertical slots of the indexing receptacle.

* * * * *